US005950252A

United States Patent [19]

Fettes

[11] Patent Number: 5,950,252

[45] Date of Patent: Sep. 14, 1999

[54] DEVICE FOR AIDING REMOVAL AND REPLACEMENT OF A SPA COVER

[76] Inventor: Ian Fettes, 2412 Holly La., Newport Beach, Calif. 92663

[21] Appl. No.: 08/781,804

[22] Filed: Jan. 10, 1997

Related U.S. Application Data

[60] Provisional application No. 60/009,767, Jan. 11, 1996.

[51] Int. Cl.[6] ..... E04H 4/06

[52] U.S. Cl. ..... 4/498; 49/386; 403/378

[58] Field of Search ..... 4/246.1, 246.3, 4/246.4, 246.5, 498, 580; 49/386; 403/378, 379

[56] References Cited

U.S. PATENT DOCUMENTS

| | | | |
|---|---|---|---|
| 3,850,336 | 11/1974 | Acosta | 49/386 X |
| 4,026,079 | 5/1977 | Morris | 403/379 X |
| 4,776,626 | 10/1988 | Seyler | 49/386 X |
| 4,853,985 | 8/1989 | Perry | 4/498 |
| 5,249,881 | 10/1993 | Austin, Jr. et al. | 403/378 |
| 5,566,403 | 10/1996 | Black et al. | 4/498 |
| 5,634,218 | 6/1997 | Ouelette | 4/498 |

*Primary Examiner*—Robert M. Fetsuga
*Attorney, Agent, or Firm*—Charles H. Thomas

[57] ABSTRACT

A device is provided for aiding in the removal and replacement of a spa cover atop a spa tub. A pair of lifting assemblies are located on opposite sides of the spa tub. Each of the lifting assemblies includes a spring having an anchored end secured relative to the spa tub and a moveable end. Each lifting assembly employs a lifting arm mounted for rotation relative to the spa tub and including a cover-engaging end attached to the spa cover, a spring-engaging end attached to the moveable end of the spring, and a fulcrum located between the lifting arm ends. The lifting arm is rotatable between extreme covering and uncovering positions in which the spring-engaging end of the lifting arm lies on opposite sides of a straight line extending between the lifting arm axis of rotation and the anchored end of the spring. The lifting arm is rotatable through an intermediate position in which the spring-engaging end of the lifting arm passes between the fulcrum and the anchored end of the spring. At this intermediate position the spring force is at a minimum. The lifting device thereby tends to balance the gravitational moment exerted by the cover on the lifting arms more closely than is achieved with conventional devices. In an alternative arrangement the fulcrum of the lifting arm is located at one end thereof and the moveable end of the spring is joined to the lifting arm at an intermediate spring coupling. A clamping mechanism is employed to lock the lifting arm to prevent accidental closure of the cover.

8 Claims, 14 Drawing Sheets

DEVICE FOR AIDING REMOVAL AND REPLACEMENT OF A SPA COVER

This application claims benefit of provisional application Ser. No. 60/009767, filed Jan. 11, 1996.

BACKGROUND OF THE INVENTION

1. Field of the Invention

The present invention relates to a system for aiding a user in moving a spa cover between open and closed positions.

2. Description of the Prior Art

Residential spas are widespread sources of enjoyment and relaxation. Such spas are typically formed with dimensions several feet on a side. Spas may be located in the ground, within a gazebo, or surrounded by a deck. They are preferably covered when not is use both to maintain water temperature and to prevent contamination of the spa water. Spa covers typically employ a rigid frame across which a cover of wood, fabric, or plastic is spread. Due to their relatively large size, spa covers can be rather heavy.

At present there are various assist mechanisms available for moving a spa cover between open and closed positions. However, conventional spa cover systems do not provide a convenient, space conserving storage arrangement for storing a spa cover when the cover is removed to allow use of the spa. Rather, conventional spa covers, when moved from a position covering the spa into an open position, are sometimes mounted on hinge mechanisms which allow the spa covers to be rotated between a generally horizontal orientation above the surface of the spa and a generally vertical orientation extending upwardly along one edge of the spa deck.

When a spa cover is rotated upwardly roughly through an arc of about ninety degrees, and stored in an upright disposition extending upwardly above the level of the spa deck, it blocks any light coming into the enclosure in which the spa is located from the direction of the edge of the spa at which the spa cover is hinged.

Also when a spa cover is rotated upwardly and stored in this manner, the presence of the spa cover looming overhead is both unsightly and somewhat threatening. That is, even if the spa cover is secured against downward rotation by fastenings to a wall or some other abject, it leaves a visual impression of being likely to fall shut unexpectedly. Since a spa cover measures several feet in each direction, even when folded in half for storage, this conventional storage arrangement is unsatisfactory.

In an alternative conventional arrangement the spa cover is fully opened through an arc of approximately one hundred eighty degrees from a generally horizontal position lying atop the spa to a generally horizontal disposition lying to one side of the spa. The spa cover is opened and closed by hinge mechanisms. The difficulty with this arrangement is that a considerable amount of space must be dedicated to receiving the spa cover for storage to one side of the spa when the cover is opened, even if it is folded in half at its center. Often there is simply inadequate space within which to mount a spa so that it can be rotated one hundred eighty degrees between open and closed positions and stored in a laterally extending orientation to one side of the spa. While systems have been devised to aid a user in lifting a spa cover, no good system has yet been devised for providing compact storage for a spa cover.

Due to its considerable mass, a spa cover mounted on a conventional mounting system is quite heavy to lift from a closed position into an open position. Considerable strength is required to lift the spa cover through an arc of ninety degrees in moving it to cover and uncover the spa tub. Furthermore, considerable strength is required to prevent the spa cover from falling from a vertical disposition into either the horizontal open or horizontal closed positions when preparing the spa tub for use or in covering the spa tub following use.

SUMMARY OF THE INVENTION

The present invention involves a spa cover guidance and storage system which substantially reduces the amount of space required for storage of a spa cover when the spa is to be uncovered and used. The preferred embodiment of the mounting system of the invention allows the spa cover to be opened from a generally horizontal disposition extending across the top of the spa tub into a generally vertical disposition lowered into a relatively narrow, vertical space immediately adjacent to the spa. Thus, with the preferred embodiment of the invention the spa cover does not extend upwardly above the level of the spa deck so as to form a visual barrier, but rather is moved through a hinge mechanism into a position where it is tucked neatly into a storage area immediately adjacent to the spa.

A further feature of the spa cover of the preferred embodiments of the invention is that the user is assisted by coil springs, rather than air cylinders in opening and closing the spa. Preferably, the springs are formed as coil springs which are extended in tension as the spa cover is lowered into position to cover the surface of the spa. As a result, when the user starts to open the spa cover, the contracting springs assist the user in raising the spa cover from atop the spa tub.

Preferably also the system is constructed so that the springs are in an equilibrium position when the spa cover is approximately halfway open. As the spa cover moves beyond the half open position down into its storage area, the springs are again extended so as to cushion the spa cover as it descends into the storage area next to the spa. By using springs and appropriate mounting structures, hereinafter to be described, the spring force can be brought to bear both in lifting the spa cover, and in cushioning its descent as it is lowered into a storage position. Conventional air cylinder spa cover lift assisting devices do not provide this feature.

A further feature of the invention allows a single, universally- adaptable, spring-assisted spa cover lifting device having a pair of lifting assemblies to be employed in conjunction with spa covers of widely varying size. This is achieved by providing the spa cover lifting mechanism with telescoping arms that can be adjusted to fit spa covers of different lengths. Once the telescoping portions of the arms have been moved to form arms of appropriate lengths, the arm portions are permanently locked together so as to maintain the selected length for the particular spa cover with which the lifting mechanism is employed. As a result, the spa cover mounting mechanism may be utilized with very large spas as well as very small spas.

In one broad aspect the present invention may be considered to be a device for aiding removal and replacement of a spa cover atop a spa tub. The invention is comprised of at least one lifting assembly secured relative to the spa tub. Each lifting assembly includes a spring and a lifting arm. The spring has an anchored end secured relative to the spa tub and a moveable end. The lifting arm is mounted for rotation relative to the spa tub and includes a cover-engaging end attached to the spa cover, a spring-engaging end attached to the moveable end of the spring, and a fulcrum located between the lifting arm ends. While a single assembly can be employed centered at one end of the spa tub, a pair of lifting assemblies are preferably employed and are located on opposite sides of the spa tub.

The fulcrum defines a lifting arm axis of rotation. The lifting arm is rotatable between extreme covering and uncovering positions in which the moveable end of the lifting arm lies on opposite sides of a straight line extending between the lifting arm axis of rotation and the anchored end of the spring. The lifting arm is rotatable through an intermediate position in which the moveable end of the lifting arm lies on this straight line. In this way the spring exerts a spring biasing moment on the lifting arm urging the lifting arm toward the intermediate position. The spring thereby exerts a greater force that aids in initially lifting the cover from its deployed position flat atop the spa tub than it does when the cover has been raised to a more upright disposition. The cover exerts a gravitational moment on the lifting arm that opposes the spring biasing moment when the lifting arm is at the extreme positions. The spring biasing moment is less than the gravitational moment.

The spring may be a coil spring, a pneumatic spring, a hydraulic spring, or a spring formed of some resilient material, such as rubber or elastic. Preferably the spring employed is a coil spring biased in tension. That is, the spring is stretched in order to secure the anchored spring end relative to the spa tub and the moveable end to the spring-engaging end of the lifting arm. The spring thereby tends to contract so as to draw the spring-engaging end of the lifting arm into linear alignment with the anchored end of the spring and the lifting arm fulcrum.

In one embodiment of the invention the fulcrum is attached to the tub near the top thereof. A mounting bracket is employed for this purpose and is secured to either the wall of the tub or to the lip extending around the circumference of the tub. The anchored ends of the springs in both of the lifting assemblies are attached to the wall of the tub near the bottom thereof, preferably by lag eye bolts. The closed loop of the lag eye bolt protrudes from the side of the spa tub and the hook at the anchored end of the spring engages this closed loop.

In an alternative embodiment of the invention, on the other hand, fasteners need not be embedded in the tub. Rather, a supporting stand may be provided for each of the lifting assemblies. Each supporting stand has a base with a horizontally oriented, flat bearing plate that extends inwardly beneath the spa tub. The weight of the spa tub and the water within it thereby secures the base to the supporting surface upon which the spa rests. The base also has an upright mounting apparatus that extends alongside the tub and to which both the anchored end of the spring and the fulcrum of the lifting arm are secured for each lifting assembly.

The foregoing type of lifting device is preferable where there is room at the end of the spa to accommodate the spa cover when the cover is removed to allow the spa to be used. In such an installation the spa cover is raised from the tub and lowered into a storage area adjacent one end of the spa tub, resting upon the same surface as the spa tub. This installation has the advantage of moving the spa cover completely out of the way so that it does not reside in a disposition looming over the tub.

Some spa enclosures allow insufficient room at the end the spa tub within which to store the cover, however. To accommodate such spa installations a different embodiment of the invention must be employed.

Accordingly, in another broad aspect the invention may be considered to be a device for aiding in the placement of a spa cover atop a spa tub and the removal of the spa cover therefrom. The device is comprised of at least one lifting assembly secured relative to the tub. Again, while a single lifting assembly can be employed centered at one end of the tub, a pair of lifting assemblies are preferably located on opposite sides of the spa tub. Each lifting assembly includes a spring and a lifting arm. The spring has an anchored end secured relative to the spa tub and a moveable end. The lifting arm is mounted for rotation relative to the spa tub and includes a cover-engaging end attached to the spa cover, a fulcrum end secured relative to the spa tub at a distance from the anchored end of the spring, and an intermediate spring coupling located between the lifting arm ends and forming a hinged connection with the moveable end of the spring. The device is also comprised of a support rod having a fixed end secured relative to the spa tub and an opposite, moveable end which passes adjacent the lifting arm in sliding engagement relative thereto. The device also includes a clamp for releasably locking the support rod to the lifting arm to prevent relative movement therebetween.

In an installation where insufficient room exists at the end of a spa within which to store the cover, the user has no choice but to store the spa cover elsewhere. Employing the device designed for such an installation according to the invention, the spa cover is raised into an upright disposition atop one end of the spa tub. However, unlike conventional systems, the support rod and clamp employed are provided to ensure that the spa cover remains upright, and cannot possibly swing down to a closed position. The clamp that engages the support rod and holds it in fixed disposition relative to the lifting arm ensures that this cannot happen.

The clamp is also useful when the spa cover is in its closed or deployed position atop the spa tub. Engagement of the clamp when the spa cover lies atop the tub ensures that the cover cannot be lifted unless the clamp is released. This not only acts as a safety feature with respect to small children, but also allows a gas spring or coil spring of higher rating to be used. Be employing a gas spring having more gas in the cylinder, or a coil spring exerting a greater opening force, the ease with which the cover can be lifted is increased. Indeed if desired the spring can be matched to the spa cover so as to be powerful enough to lift the cover automatically once the clamp is released, if desired.

By employing a clamping arrangement such as this, it is possible to provide a spring more finely tuned to the weight of the spa cover so that the spa cover can be lifted with very little force. The user is thus provided with a device having finger tip control. Because the spa cover is held by the clamp in a secured position raised from the spa tub, it cannot fall down. Because the spa is held by the clamp when the cover lies atop the spa tub, the cover cannot be raised unless the clamp is released.

As with the other embodiments of the invention, different types of springs may be employed in the device employing a support rod and clamp in each lifting assembly. That is, in one embodiment of the invention the spring is a coil spring biased in tension. In another embodiment the spring is a gas spring in which compressed gas within a cylinder tends to urge a piston out of the cylinder.

Preferably, in many of the embodiments of the invention, there is a link of adjustable effective length interposed between the spring-engaging ends or couplings of the lifting arms and each of the moveable ends of the springs. This permits an adjustment of spring force acting on the lifting arms. To this end, the links may include a plurality of apertures therethrough spaced along the lengths of the links. The moveable ends of the springs may be coupled to the links at selected apertures so as to vary the force exerted on the spa cover by the springs in accordance with the strength of the springs, weight of the spa cover, size of the spa, and length of the lifting arms.

In all embodiments of the invention, it is advisable for the lifting arms to be of adjustable length. For this reason the lifting arms preferably each employ at least one set of telescoping members with an annular collar interposed therebetween. These annular collars are preferably compressible in nature and have elements that may be forced in between the inner and outer telescoping members and compressed therebetween so as to exert a frictional force resisting relative movement between the telescoping members. The collars also include radially outwardly projecting annular flanges that reside in abutment against the coupling ends of the outer telescoping members when the collars are wedged into position between the inner and outer telescoping members. For added security and stability set screws or bolts are additionally employed to ensure that the frictional force longitudinally immobilizing the telescoping members in each set relative to each other is not exceeded.

Still another important feature of the invention is the manner of engagement of the cover-engaging ends of the lifting arms with the spa cover. A conventional spa cover is comprised of a pair of sections joined to each other by a hinge that extends transversely between the opposite sides of the spa tub. To remove the spa cover, one of these spa sections is folded over the top of the other at the hinge. Accordingly, the device of the invention is preferably provided with transverse, lower, cover-engaging members that extend from the cover-engaging ends of the lifting arms inwardly beneath the spa cover hinge. Also an upper, transverse, cover-engaging member extends between the cover-engaging ends of the lifting arms above one of the spa cover sections. The lower, transverse, cover-engaging members exert an upward force on the spa cover to effectuate raising of the cover and prevent the cover from falling shut. The upper, transverse, cover-engaging member holds the spa cover to the lifting arms when the spa cover is raised to an upright disposition.

The invention may be described with greater clarity and particularity by reference to the accompanying drawings.

DESCRIPTION OF THE EMBODIMENT

Figure 1:
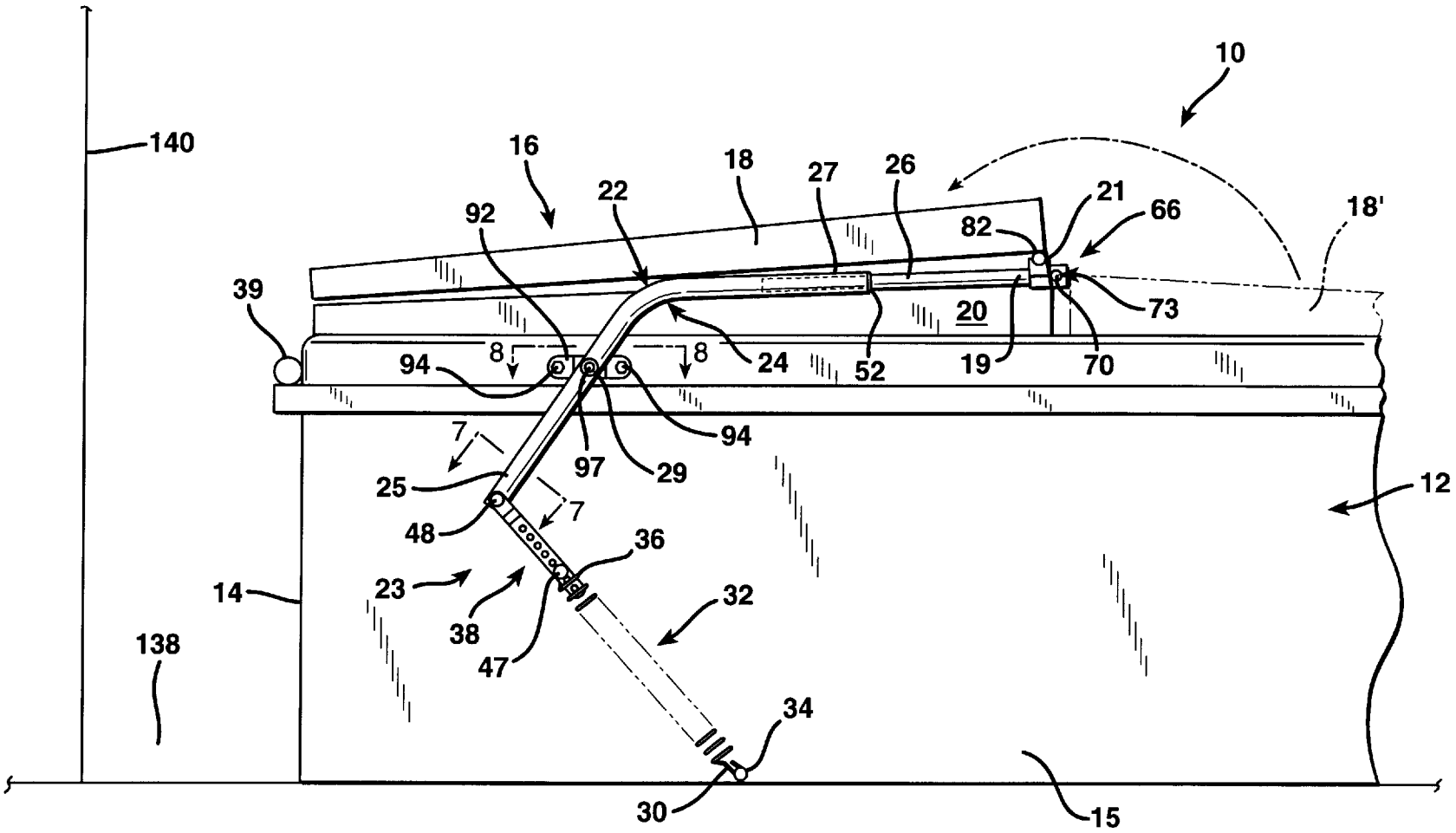
FIG. 1 is a side elevational diagrammatic view illustrating a portion of a spa installation employing one preferred embodiment of a device according to the invention and in which the spa cover has been folded in half in preparation for opening, but still remains disposed in a position in which half of the spa tub remains covered.

FIG. 1 illustrates a conventional, generally rectangular-shaped spa, the left-hand portion of which is illustrated at 10. The spa 10 may be a prefabricated, fiberglass structure in which a concave, upwardly facing tub 12 has a generally rectangular cover 16 disposed thereatop. The spa cover 16 is preferably formed of a thermally insulating, water insensitive material, such as rigid polyurethane foam, enclosed within a fabric casing of some water-proof material, such as vinyl plastic. The peripheral edges of the spa cover 16 are supported about the perimeter of the tub 12 by upright, vertical end walls 14 and upright, vertical side walls 15.

The spa cover 16 is divided longitudinally into two halves 18 and 20 which are hinged together by a transversely-extending hinge 21. The spa cover portion 18 can be unfolded from atop the spa cover portion 20 to extend horizontally as indicated at 18' as shown in FIG. 1. When the spa cover portion 20 is in the horizontal covering position illustrated in FIG. 1, and the spa cover portion 18 is unfolded to extend longitudinally therefrom to the unfolded position indicated at 18', the spa cover 16 is in its completely closed condition and covers the entire surface of the water within the spa tub 12. The spa cover 16 rests on the upper edges of all of the walls 14 and 15 when it is completely closed in this manner.

To open the spa cover 16 from its fully closed position, the user first folds back the spa cover portion 18 about the hinge 21 until the spa cover portion 18 rests atop the spa cover portion 20. The spa cover 16 is shown in solid lines in FIG. 1 folded in preparation for lifting. At this point half of the water surface of the spa 10 in the tub 12 is covered while the other half is exposed.

Figure 7:
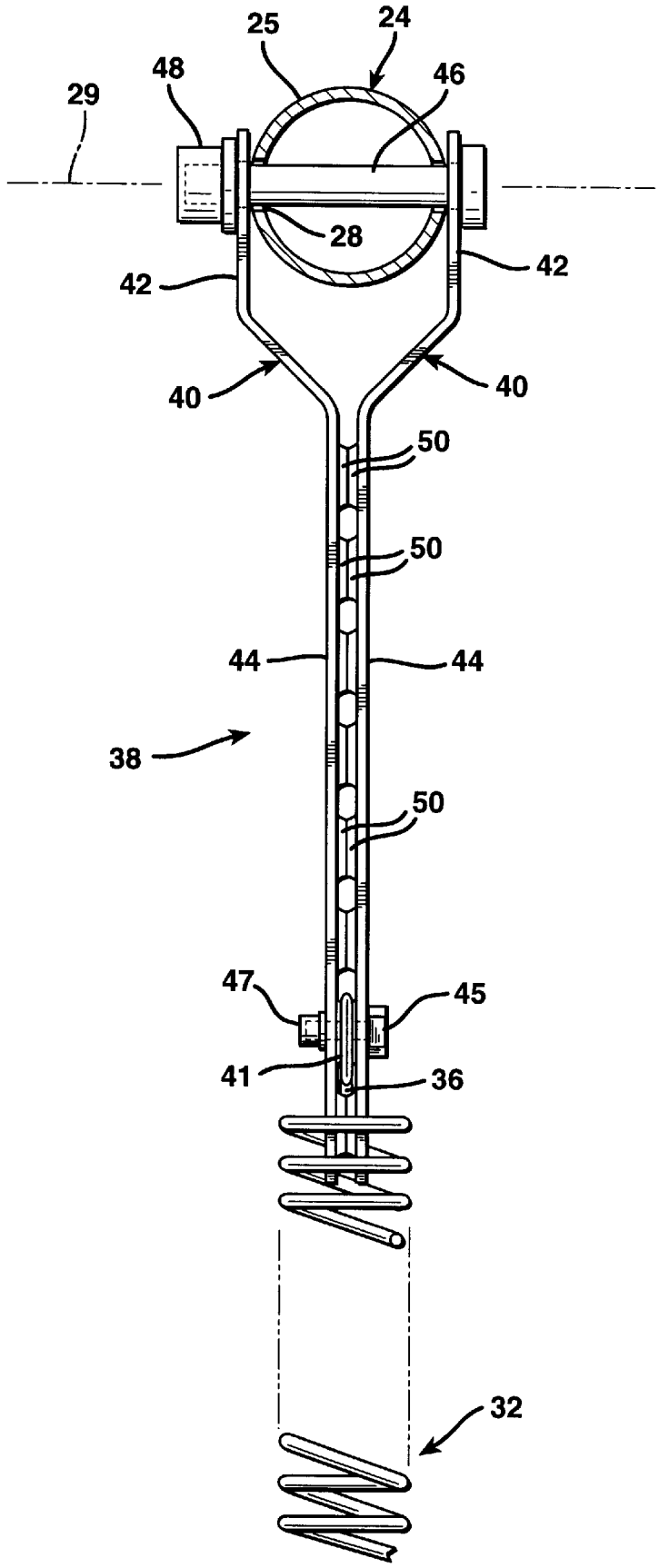
FIG. 7 is a transverse sectional detail taken along the lines 7—7 of FIG. 1.

The spa cover 16 is mounted atop the spa tub 12 by means of a pair of lifting assemblies 23, each of which employs a lifting arm 22. Each of the lifting arms 22 is configured with a pivot arm member 24 formed of tubular steel having a cylindrical, annular cross section with an internal diameter of about 1.5 inches and a wall thickness of about one-sixteenth of an inch. The pivot arm member 24 is about thirty-one inches in length overall and has a spring-engaging end 25 and an opposite coupling end 27. The pivot arm member 24 is bent at an angle of approximately one hundred thirty-five degrees about half way along its length and includes a fulcrum 28, formed as a transverse opening through its structure, as illustrated in FIG. 7, about thirteen inches from the longitudinal extremity of the spring-engaging end 25. The fulcrum 28 defines an axis of lifting arm rotation 29. The lifting arm 22 also includes an extension arm member 26, likewise formed of tubular steel, preferably about one inch in outer diameter with a wall thickness of one-sixteenth of an inch. Unlike the pivot arm member 24, the extension arm member 26 is not bent.

Figure 5:
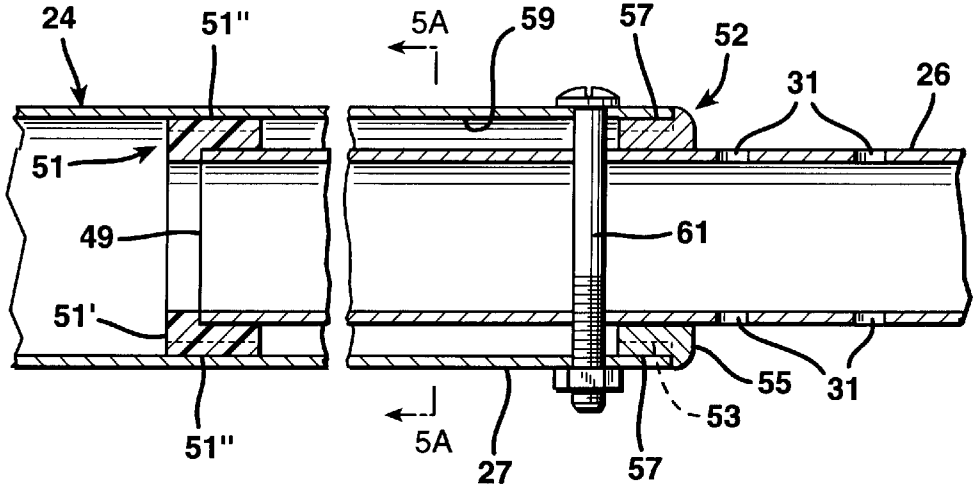
FIG. 5 is a sectional elevational detail illustrating the interconnection of the telescoping members of one of the lifting arms illustrated in FIGS. 1 and 2.
Figure 6:
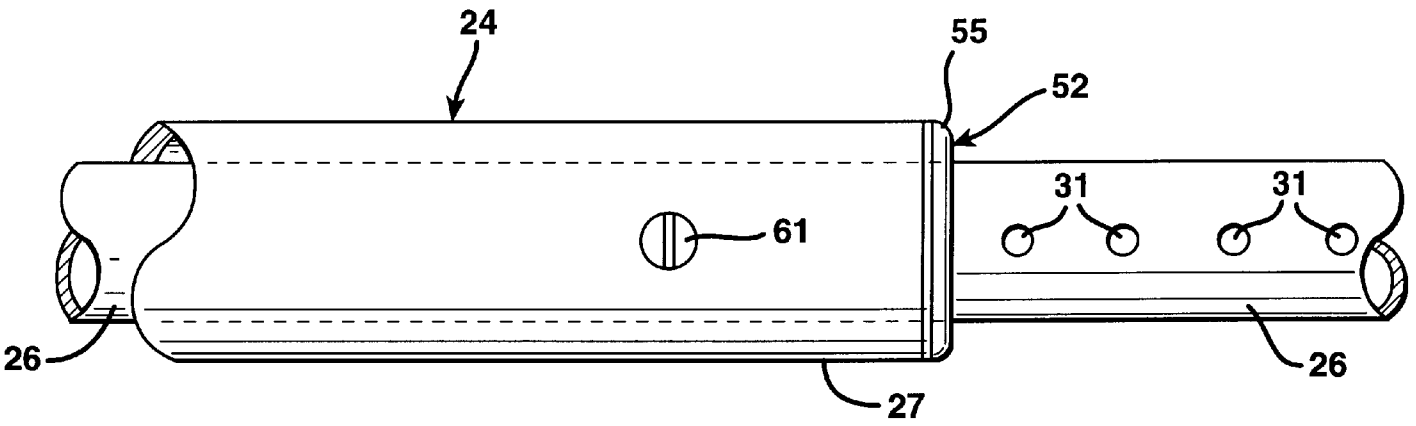
FIG. 6 is a top plan view of the interconnection shown in FIG. 5.

A portion of the extension arm member 26 is disposed within the straight, coupling end 27 of the pivot arm member 24, while another portion of the extension arm member 26 protrudes longitudinally therefrom beyond the edge extremity of the coupling end 27. The extension arm member 26 includes several longitudinally spaced set screw openings 31 therein, which are depicted in FIGS. 5 and 6. The extension arm member 26 preferably has an overall length of about fifteen inches. The coupling end 27 of the pivot arm member 24 serves as an outer telescoping member, while the extension arm member 26 serves as an inner telescoping member. Together, the members 24 and 26 form a set of telescoping members on each side of the spa 10.

The engagement of the cover-engaging ends 19 of the lifting arms 23 with the cover 16 is best explained with reference to FIG. 3. In that drawing figure the component parts of the spa cover 16 are omitted so as not to obscure the structure of the cover lifting device of the invention.

Figure 3:
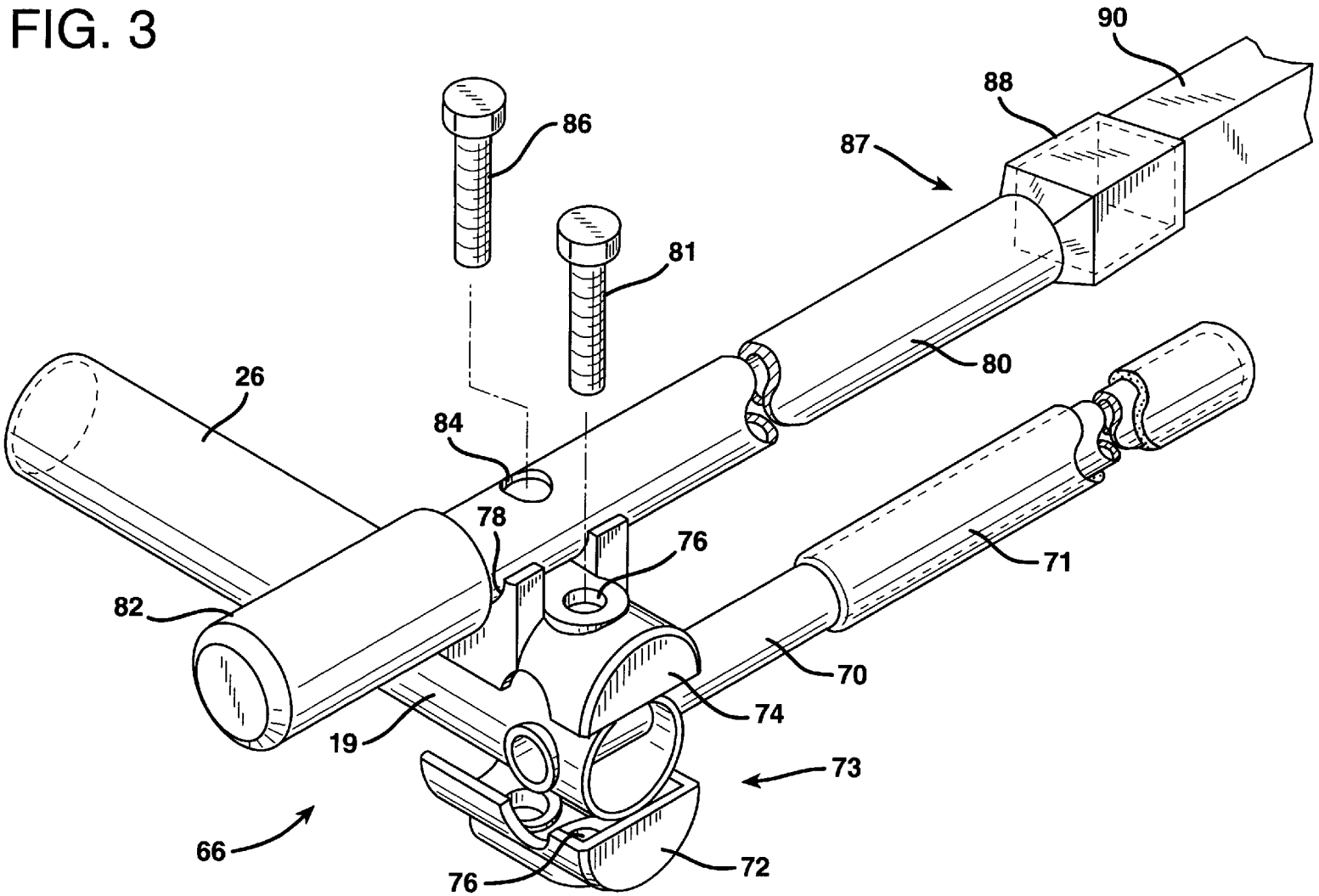
FIG. 3 is a perspective detail illustrating the cover-engaging end of one of the lifting arms and the connections thereto of upper and lower, transverse cover-engaging members.

As shown in FIG. 3, each cover-engaging end 19 of each lifting arm assembly 23 has diametrically opposed, transverse, horizontally aligned openings therethrough approximately 0.520 inches in diameter centered about 1.439 inches from the annular edge extremity of the cover-engaging end 19. These transverse, diametrically opposed openings receive the ends of a cylindrical, lower, hinge-engaging bar 70 formed of tubular steel one half of an inch in outer diameter. Each hinge-engaging bar 70 is covered with a padded, vinyl coating 71 where it protrudes inwardly from the cover-engaging end 19 of the lifting arm 24 so as to avoid any puncturing or tearing of the vinyl structure of the cover 16. The lower, hinge-engaging bar 70 of each lifting assembly 23 projects in an inboard direction about seven inches from the cover-engaging end 19 to which it is fastened. Each hinge-engaging bar 70 thereby engages the underside of the lateral edges of the hinge 21 of the cover 16.

Each hinge-engaging bar 70 is drilled with diametrically opposed apertures therethrough that are aligned perpendicular to the openings in the cover-engaging end 19 through which the hinge-engaging bar 70 extends and is attached. The cover-engaging end 19 is also drilled with a corresponding coaxial set of apertures therethrough oriented perpendicular to the apertures that receive the hinge-engaging bar 70 and at a distance of 1.439 inches from the end extremity of the cover-engaging end 19.

Each cover-engaging end 19 is also provided with a cradle assembly 73 formed by two glass-filled, nylon, molded component parts 72 and 74 that fit together in mating fashion. Both of the parts 72 and 74 include corresponding coaxially-aligned openings 76 therethrough that are coaxially-aligned with the corresponding diametrically-opposed openings in the cover-engaging end 19 of the lifting arm 22 and the hinge-engaging bar 70. A bolt 81 passing through all of these openings secures the cradle components 72 and 74 together and also firmly secures the hinge-engaging bar 70 in position projecting inwardly from the cover-engaging end 19 of the lifting arm 23.

The upper cradle component 74 also includes a concave, transversely-oriented, semicircular saddle 78 formed with a curvature to conform to the outer cylindrical surface of the outboard end of an outboard tube 80 seated therein. The outboard end of the outboard tube 80 has an outer diameter of about three-quarters of an inch and is equipped with a padded handgrip 82 at its extreme outboard extremity. The handgrip 82 extends in an outboard direction from the inner end 19 of the lifting arm 22 in a perpendicular orientation relative thereto.

Immediately inboard from the handgrip 82 the outboard tube 80 has a pair of diametrically opposed drilled apertures 84 that are coaxially aligned with corresponding drilled apertures through the saddle 78 in the upper cradle piece 74 and through the cover-engaging end 19 of the lift arm 23. The openings 84 in the outboard tube 80, and the corresponding openings in the upper and lower cradle sections 74 and 76 and in the cover-engaging end 19 are aligned to receive a bolt 86 that secures the outboard tube 80 in the saddle 78 of the upper cradle section 74 and to the cover-engaging end 19 of the lifting arm 22.

Figure 4:
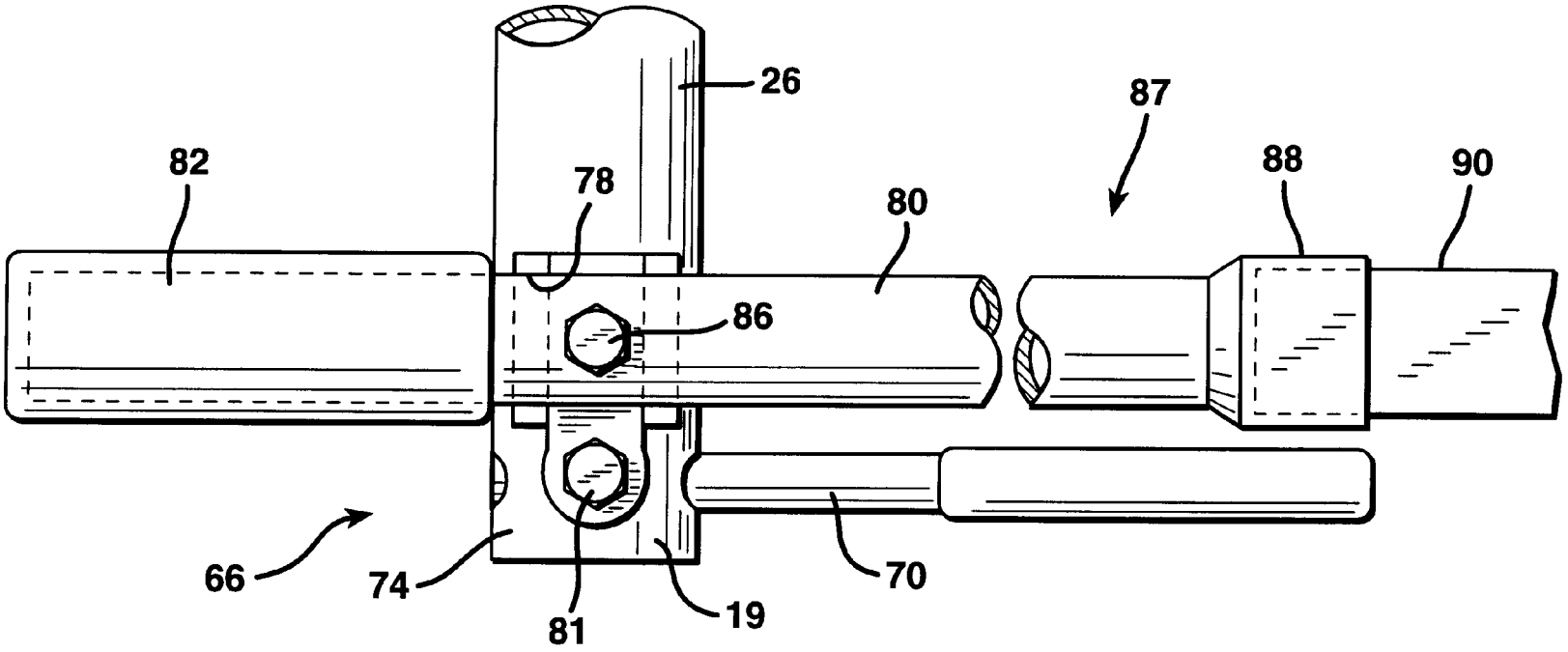
FIG. 4 is a top plan detail of the cover-engaging end of one of the lifting arms, and the connections of the transverse cover-engaging members thereto.

The outboard tubes 80 attached to the lifting arms 22 of each of the lifting assemblies 23 on each side of the spa 10 extend in an inboard direction from the bolts 86 a distance of about thirty-three inches. As illustrated in FIG. 4, the inboard extremities 88 of the outboard tubes 80 are configured into a square cross section so as to receive therewithin the ends of a torsion tube 90, likewise having a square cross section. The outboard end extremities of the torsion tube 90 are seated snugly in telescoping fashion within the inboard ends 88 of the outboard tubes 80. The torsion tube 90 is of a uniform cross section throughout and has a square cross sectional configuration measuring one-half of an inch on each side. As provided, the torsion tube 90 is thirty-six inches in length, although it may be cut down as necessary to accommodate the width of the spa 10 upon which the lifting device of the invention is installed.

Together the pair of outboard tubes 80 that are secured to the cover-engaging ends 19 of the lifting arms 22 in the two lifting assemblies 23 and the inboard torsion tube 90 form an upper, transverse, cover-engaging member 87. The inboard ends of the outboard tubes 80 are of polygonal cross section and are directed toward each other. The inboard connecting tube 90 has opposing ends of corresponding polygonal cross section that telescopically engage the inboard ends 88 of the outboard tubes 80. As a consequence, when the spa cover 16 is lifted by raising one or the other of the handgrips 82 on a selected side of the spa 10, the upper, transverse, cover-engaging member 87 ensures that the lifting arm 22 of the other lifting assembly 23 closely follows the movement of the lifting arm 22 at which the lifting force is applied. Without the torsion resisting arrangement provided by the upper, transverse cover-engaging member 87, the lifting arm 22 at the far side of the spa 10, opposite the lifting assembly 23 at which the lifting force is applied, would sag and lag in movement behind the lifting assembly 23 at which the force is applied in raising the cover 16.

Each lifting assembly 23 includes an extended coil spring 32 having an anchored end 30 that is secured relative to the spa tub 12 by means of a lag bolt 34 and an opposite, moveable end 36. The spring-engaging end 25 of the pivot arm 24 of each lifting arm 22 is attached to the moveable end 36 of one of the extended coil springs 32 by means of a link 38 of adjustable effective length. There is a link 38 interposed between each of the spring-engaging ends 25 of the lifting arms 22 and each of the moveable ends 36 of the extended coil springs 32 to permit adjustment of tension on the coil springs 32.

One of the links 38 is illustrated in detail in FIG. 7. Each link 38 is formed of a pair of metal straps 40, each of which is bent outwardly to form a pivot arm connecting leg 42, and inwardly to form an elongated spring-connecting leg 44. Each of the pivot arm connecting legs 42 is drilled with an opening to receive a clevis pin 46 that extends through the openings in the pivot arm legs 42 of the straps 40 and through the spring-engaging end 25 of the pivot arm 24, which is embraced between the pivot arm connecting legs 42. The clevis pin 46 is secured in position with a nut that is covered with a plastic push cap 48 and is coaxial with the lifting arm axis of rotation 29.

The spring-engaging legs 44 are each formed with a plurality of inwardly projecting bosses 50 which are equally spaced from each other along the length of the spring-engaging legs 44. The bosses 50 preferably project inwardly from the inner surface of the spring-engaging legs 44 a distance of about 0.075 inches, so as to create a gap of 0.15 inches between the facing spring-engaging legs 44. The moveable end 36 of the spring 32 is formed as a longitudinally extending length of the spring wire, the end extremity of which is formed into an eye 41. The gap between the abutting bosses 50 is sufficient to accommodate the eye 41 at the moveable end 36 of the extended spring 32.

In assembling the device the spring-engaging legs 44 of the metal straps 40 are inserted down into the lumen formed within the coils of the spring 32 until the eye 41 of the moveable end 36 of the spring 32 is located in alignment with a selected set of the bosses 50 on the spring-engaging legs 44 of the link 38. The selected bosses 50 are brought into abutment with each other through the eye 41 of the spring end 36. Another clevis pin 45 is then passed through the selected bosses 50 and thereby through the eye 41 of the spring end 36 and secured with a push cap 47, as illustrated in FIG. 7.

As is evident, the tension in each spring 32 may be adjusted depending upon the set of bosses 50 which are selected to engage the eye 41. To increase the tension on the spring, the eye 41 of the moveable spring end 36 will be positioned in engagement with a set of bosses 50 closely adjacent the pivot arm engaging legs 42 of the straps 40. To reduce tension on the spring 32, the eye 41 of the moveable spring end 36 will be positioned to engage a set of bosses 50 more remote from the pivot arm engaging legs 42. The user is thereby able to adjust the tension of the spring 32 to create an appropriate counterbalancing force that opposes, but is slightly less than the force of gravity on the cover 16 as the lifting assemblies 23 move the cover 16 between a position covering the spa tub 12, depicted in FIG. 1, and the uncovering position depicted in FIG. 2.

Figure 8:
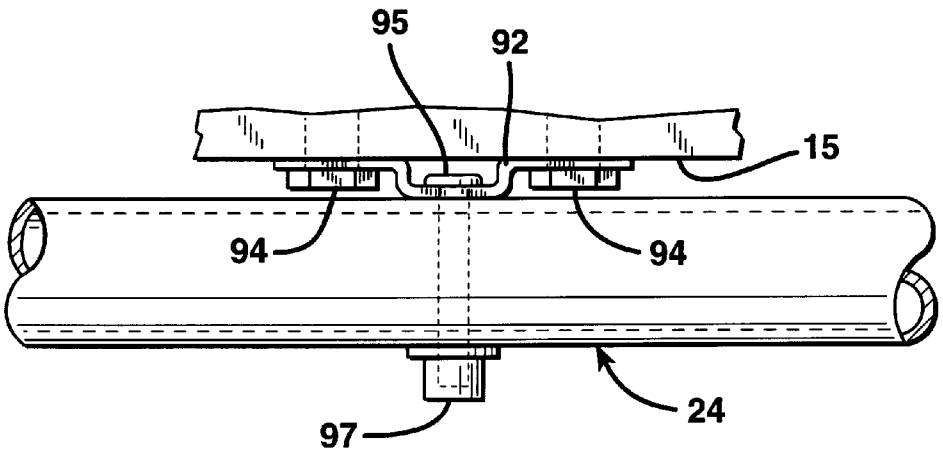
FIG. 8 is a sectional detail taken along the lines 8—8 of FIG. 1.

A pair of mounting brackets 92 are employed to secure the lifting arms 22 of the lifting assemblies 23 to the upper portion of the spa tub 12 in the embodiment of FIGS. 1–8. Each of the mounting brackets 92 is formed as a short metal strap about three and three-quarters inches in length having apertured ends and an apertured central region recessed from the ends. A clevis pin 95 is first inserted through the apertured central region of the mounting bracket 92 with the clevis pin shank extending outwardly therefrom as depicted in FIGS. 8. A pair of lag bolts 94 are then employed to secure the mounting bracket 92 to the opposite side walls 15 of the spa tub 12 in the upper portions thereof. The links 38 and pivot arms 24 are then mounted on the clevis pins 95 in the manner previously described, and held in place by plastic covered push caps 97 that tightly engage the tips of the shanks of the clevis pins 95.

The lower cover-engaging bar 70 are then positioned beneath the hinge 21 of the spa cover 16, and the upper, transverse cover-engaging member 87 formed by the outboard tubes 80 and the inboard tube 90 are then installed above the cover section 20, closely adjacent to the hinge 21, in the manner previously described. Together, the cover-engaging bars 70, 80 and 90 engage the cover 16 therebetween. The lifting arms 22 are then adjusted to length in the manner described later herein.

Figure 2:
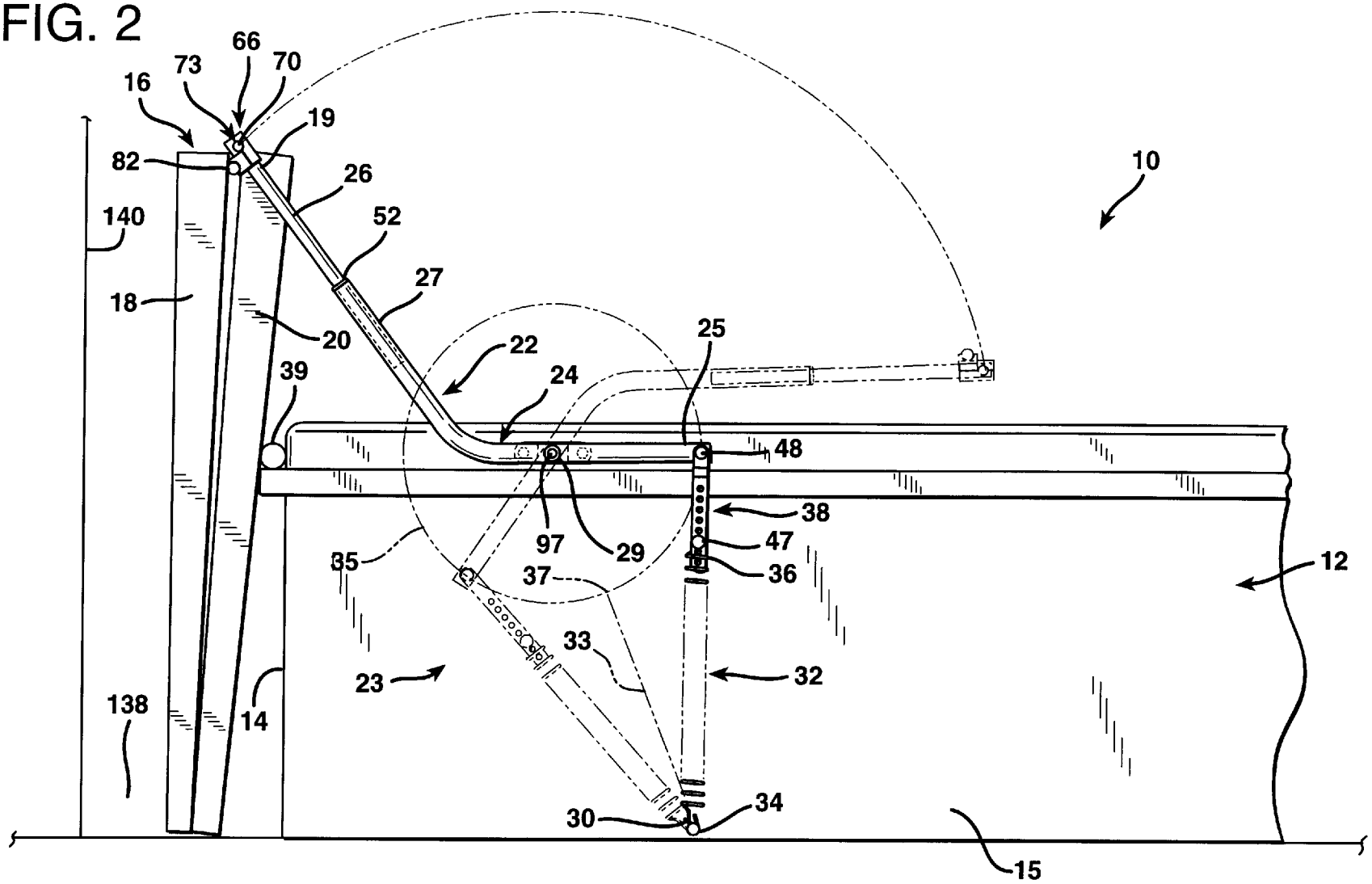
FIG. 2 is a elevational diagrammatic view illustrating the spa cover of FIG. 1 which has been removed from the spa tub to its stored position employing the device of the invention also depicted in FIG. 1.

The eye 41 at the moveable end 36 of each spring 32 is then attached to the selected set of bosses 50 in the manner previously described. The spring 32 is thereupon extended. The anchored ends 30 of the springs 32 of both lifting assemblies 23 are then secured to the side walls 15 near the bottom edges thereof as depicted in FIGS. 1 and 2 using lag eye bolts 34 that extend through hooks formed in the anchored ends 30 of the springs 32. The lag eye bolts 34 engage the hooks of the spring ends 30 and extend into the structure of the side walls 15 of the spa tub 12 beneath the level of the floor within the interior of the spa tub 12.

Together the lifting assemblies 23 on the opposite sides of the spa tub 12 form a device for aiding in the removal and replacement of the spa cover 16 atop the spa tub 12. The lifting assemblies 23 aid in the placement of the spa cover 16 atop the spa tub 12. They also aid in the removal of the spa cover 16 from the spa tub 12.

With the spa cover 16 in the closed position shown in FIG. 1, the springs 32 are in an extended condition in which they tend to urge the lifting arm 22 in counterclockwise rotation about the axis of rotation 29, as viewed in FIG. 1. However, the spa cover 16 is heavy enough so that the force of the springs 32, by themselves, will not open the spa cover 16 from the position shown in FIG. 1.

If, however, a user provides a relatively small, manual force tending to pull the spa cover 16 upwardly from the center of the spa 10 so as to rotate the cover 16 in such a manner as to move the spa lifting arms 22 in angular rotation in a counterclockwise direction about the axis 29, the spa cover 16 will move through intermediate positions to the final stored position indicated in FIG. 2. A roller 39 is centered on the back edge of the deck of the spa 10. The roller 39 aids the spa cover 16 in its movement between the positions illustrated in FIGS. 1 and 2, and is not always necessary.

In the position depicted in FIG. 2 the spa cover 16 is stored in the compact storage area indicated generally at 138 adjacent one end of the spa 10. It should be noted that in its stored position the spa cover 16 requires only a very narrow space 138, and thus can fit in between a wall 140 located only a short distance from the end wall 14 of the spa 10.

As the spa cover 16 is moved from its closed position of FIG. 1, to the open position of FIG. 2, each spring 32 is first relaxed and then extended again. That is, as the spa cover 16 is moved from the position of FIG. I to the position of FIG. 2 the spring-engaging ends 25 of the lifting arms 22 first draw closer to the anchored ends 30 of the extended springs 32 as the spa cover 16 is about half way between its closed and open positions. The fulcrum of rotation of the lifting arms 22 forms the lifting arm axis of rotation 29, which is the axis of alignment of the clevis pins 46.

Each lifting arm 22 is rotatable between the extreme covering position indicated in FIG. 1, and the extreme uncovering position illustrated in FIG. 2. In these positions the spring-engaging end 25 of each lifting arm 22 lies on opposite sides of a straight line extending between the lifting arm axis of rotation 29 formed by the clevis pins 46 and the anchored end 30 of the spring 32 that is secured by the lag bolt 34. In undergoing this movement, each lifting arm 22 is rotatable through an intermediate position in which the spring-engaging end 25 travels through an arc 35 and passes through a position 37 that lies on a straight line 33 extending between the axis of rotation 29 formed at the lifting arm fulcrum and the lag eye bolt 34, as illustrated in FIG. 2.

As is evident from FIGS. 1 and 2, the extended coil springs 32 exert a spring biasing moment on the lifting arms 22 urging the spring-engaging ends 25 thereof toward the intermediate position 37 in which the spring-engaging end 25 of each lifting arm 22 resides on the straight line 33 passing between the clevis pin 46 and the lag bolt 34. The cover 16, on the other hand, exerts a gravitational moment on the lifting arms 22 that opposes the spring biasing moment exerted by the extended springs 32 when the lifting arms 22 are at either of their extreme positions illustrated in FIG. 1 and 2. Throughout the movement of the cover 16 the spring biasing moment exerted by the extended springs 32 on the lifting arms 22 is always less than the gravitational moment exerted thereon by the weight of the spa cover 16.

In moving between the closed and open positions depicted in solid lines in FIGS. 1 and 2, respectively, the spring-engaging ends 25 of the lifting arms 22 first draw closer to the anchored ends 30 of the extended springs 32 as the spa cover 16 is about half way between its closed and open positions. The spring-engaging ends 25 then again draw further away from the anchored ends 30 of the extended springs 32. As a consequence, the springs 32 initially exert a rather strong force tending to urge the spa cover 16 from the closed to the open position. This force diminishes when the spring-engaging ends 25 of the lifting arms 22 are at the position indicated at 37 in FIG. 2 in which the springs 32 are nearly totally relaxed. As the spa cover 16 continues its motion toward the stored position within the space 138 the lifting arms 22 assume the position shown in solid lines in FIG. 2. As the lifting arms 22 rotate their spring-engaging ends 25 past the position 37, the springs 32 are again placed under tension and exert a force tending to lift the spa cover 16 from its stored position depicted in solid lines in FIG. 2 out of the space 138. However, this force is insufficient to raise the spa cover 16 upwardly from the position shown in solid lines in FIG. 2 without some light manual assistance, which is applied at a selected one of the handgrips 82.

As a result, very little manual force is required to either open or close the spa cover 16. When the spa cover 16 is in the closed position of FIG. 1, a light manual force is required and is applied at a selected one of the padded, foam rubber handgrips 82 to either open or close the spa cover 16. When the spa cover 16 is in the closed position of FIG. 1, a light manual force is required to lift the spa cover 16 so that the spring-engaging ends 25 of the lifting arms 22 travel to the position 37 shown in FIG. 2. From this point the weight of the spa cover 16 will cause it to continue its movement to the stored position shown in FIG. 2, although since the spring 32 is again extended from its most relaxed condition during this movement, the spring 32 provides a cushioning effect. Conversely, when the user wishes to close the spa cover 16 from the open position of FIG. 2, again only a relatively light manual force is required to lift the spa cover 16 from the stored position shown in FIG. 2 to the neutral position in which the spring-engaging ends 25 of the lifting arms 22 are at the position 37 on the arc 35. Thereafter, the weight of the spa cover 16 is sufficient to return it the rest of the way to the closed position shown in FIG. 1, although again the spring 32 provides a counteracting, cushioning force.

The spa lifting arms 22 may be employed with spas 10 and spa covers 16 of widely varying size. This is made possible by the adjustability of the effective length of the spa lifting arms 22 depicted and described in conjunction with FIGS. 5 and 6. The system of the invention employs a means for adjusting the effective length of the lifting arm 22 by providing for an adjustment of the portion of each extension arm 26 that protrudes from the coupling end 27 of the pivot arm member 24.

As best shown in FIGS. 1 and 2, the spa pivot arm 24 is formed as a hollow, tubular structure that is bent so that the coupling end 27 serves as a receiving socket 27 for the extension arm 26. The extension arm 26 is formed by a second, hollow tube of diameter smaller than the coupling end 27. When the spa lifting arms 22 are first coupled to the spa 10 and to the spa cover 16, the hollow tubes forming the extension arms 26 are drawn out of the sockets 27 and secured by the cover-engaging and lift grip assembly 66 to the spa cover 16 at the end of the cover section 18 at the hinge 21 between the spa cover portions 18 and 20.

The inner end extremities 49 of the extension arms 26 that project into the surrounding cylindrical portions of the pivot arms 24 are provided with annular, plastic, injection-molded end caps 51 thereon shown in FIG. 5. The end caps 51 are each formed with a radially inwardly directed annular flange 51' and a plurality of radially outwardly directed ribs 51" spaced at uniform angular increments about the circumference of the end cap 51. Preferably, the end cap 51 is provided with about twelve radially projecting ribs 51".

The extension arms 26 are also each provided with plastic, injection-molded, annular collars 52 that include a cylindrical, annular sleeve portion 53 that surrounds and extends along the outer surface of the extension arm 26, and a radially outwardly projecting annular flange 55 having an outer diameter equal to that of the outer diameter of the pivot arm 24. The cylindrical sleeve portion 53 is provided with a plurality of longitudinally extending, radially projecting ribs 57, spaced at uniform angular increments about the circumference of the sleeve portion 53. Preferably there are about twelve radially projecting ribs 57 on the collar 52.

In assembling the lifting arms 22, the annular collars 52 are first positioned upon the outer surfaces of the extension arms 26 close to the cover-engaging and lift grip assembly 66 at the cover-engaging ends 19 of the lifting arms 22. The plastic end caps 51 are inserted on the opposite inner end extremities 49 of the arm extensions 26.

The arm extensions 26 are then inserted into the straight, cylindrical coupling ends of the pivot arms 24. The radially projecting ribs 51" on the end caps 51 contact the interior surfaces 59 of the pivot arms 24, but can be forced longitudinally therealong. During the initial installation of the cover lifting device of the invention, the requisite distance between the fulcrum 29 and the cover-engaging end 19 must first be determined. The effective length of the lifting arm 22 must thereupon be adjusted so that the cover-engaging end 19 of the lifting arm 22 resides at the appropriate distance from the fulcrum 29.

When the lifting assemblies 23 are sold, the annular collars 52 are disposed about the extension arms 26 and the effective length of each lifting arm 22 is adjusted by moving the extension arm member 26 telescopically within the coupling end 27 of the pivot arm member 24 until the proper portion of the extension arm member 26 extends therefrom. The extension arms 26 are advanced into the pivot arms 24 until the cradles 73 are longitudinally aligned so that the bars 70, 80, and 90 will engage the cover 16 as previously described.

When the extension arms 26 have been moved longitudinally so that the portions thereof protruding longitudinally from the pivot arms 24 carry the cradles 73 at the proper distance to just reach the end of the cover section 20 at the hinge 21, the annular collars 52 are moved longitudinally to meet the coupling ends 27 of the pivot arm members 24. The sleeve portion 53 of the collar 52 is driven longitudinally into the open ends of the socket formed by the coupling edge 27. The annular collar 52 is then forced back toward the edge extremity of each coupling end 27 of the pivot arm member 24, thereby forcing the sleeve portion 53 and the ribs 57 in between the outer surface of the extension arm member 26 and the inner surface 59 of the coupling end 27 of the pivot arm member 24. The radially projecting ribs 57 of each annular collar 52 are thereby radially compressed between the inner and outer telescoping members 26 and 27 between which the sleeve portion 53 is interposed. The annular collar 52 is forced longitudinally toward the pivot arm member 24 until the outer annular flange 55 resides in abutment against the transverse annular edge of the coupling end 27.

The compression of the inner ribs 57 between the outer, telescoping, tubular member 27 and the inner, telescoping, tubular member 26 creates a very large frictional force that resists movement of the members 26 and 27. Thus, the pivot arm member 24 and the extension arm member 26 are immobilized relative to each other. Use of the end caps 51 and the annular collars 52 has the further advantage of avoiding metal-to-metal contact and minimizing any wobbling of the extension arm member 26 relative to the pivot arm member 24 due to the clearance provided between the respective outer and inner diameters of these members, respectively.

The ribs 51" and 57 of the end caps 51 and collars 52, respectively, serve to hold the arm extensions 26 in precise coaxial alignment relative to the coupling ends 27 of the pivot arms 24, and thereby eliminate the wobbling that would otherwise occur between telescoping metal members due to the necessary clearance required therebetween. The frictional forces exerted by the ribs 51" and 57 also aid in fixing the length of the lifting arms 22 at the precise length required for the particular spa cover 16 with which they are to be utilized.

To ensure against any longitudinal movement between the extension arm member 26 and the pivot arm member 24, it is best to install a bolt 61, as illustrated in FIGS. 5 and 6. The bolt 61 fits through a apertures in the top and bottom of the coupling end 27 of the pivot arm member 24 and engages whichever of the diametrically opposed pairs of set screw openings 31 in the extension arm 26 is radially aligned therewith. The bolt 61 thereby ensures against any longitudinal movement of the members 26 and 27. Bolts 61 project through diametrically opposed openings in the socket 27, and a selected set of corresponding diametrically opposed openings 31 in the arm extensions 26 to completely longitudinally immobilize the arm extensions 26 relative to the pivot arms 24.

Figure 9:
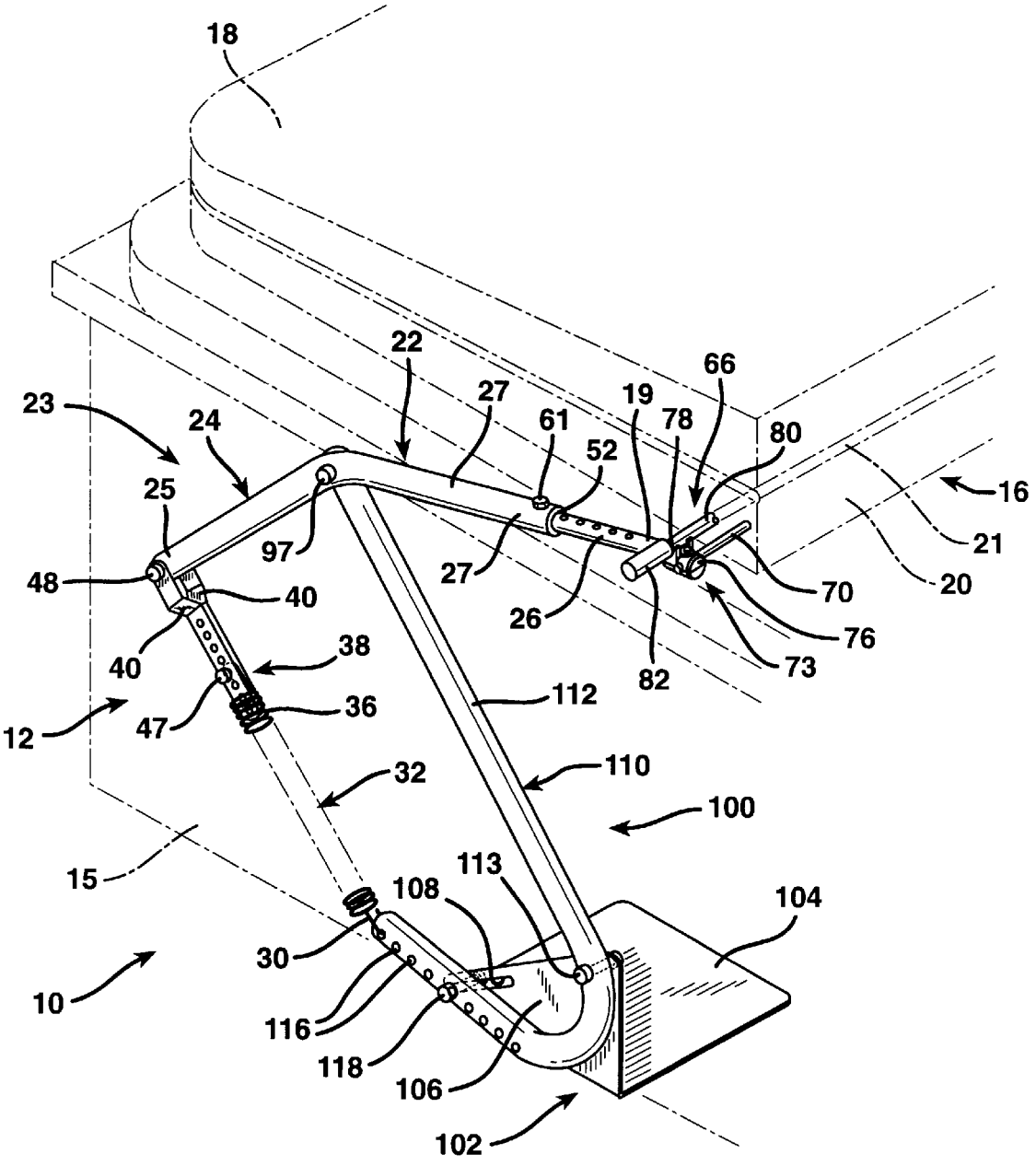
FIG. 9 illustrates a variation of the embodiment of the device depicted in FIGS. 1–8 in which a stand is employed for mounting the operating components of the invention.
Figure 10:
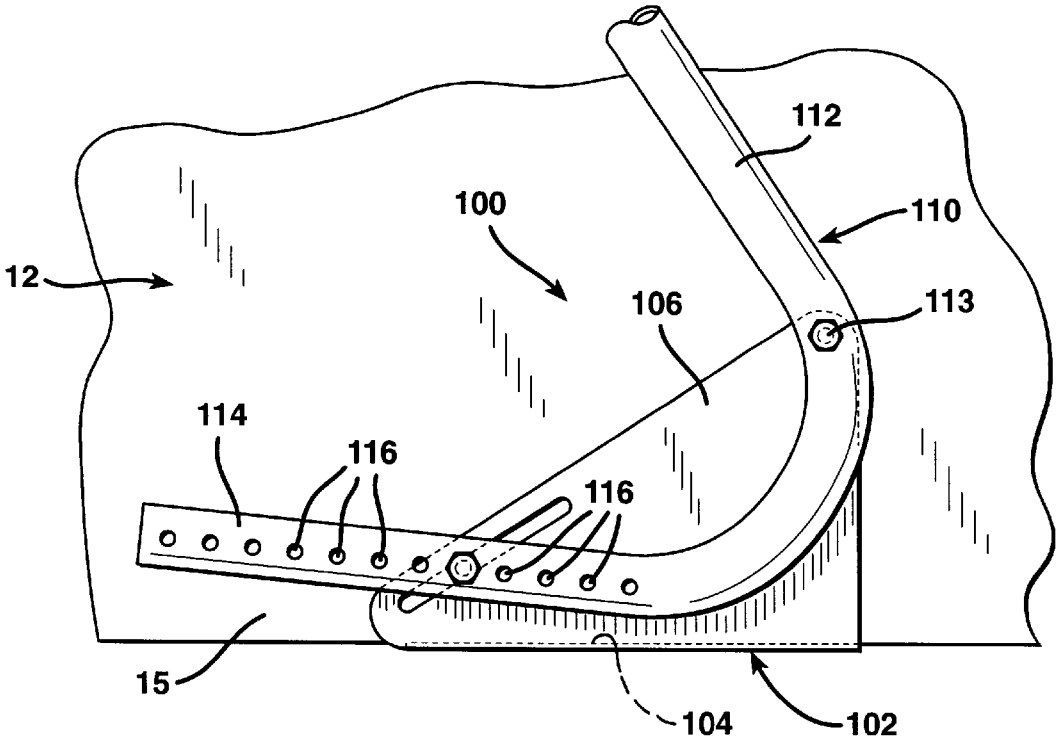
FIG. 10 is a side elevational detail showing the stand of FIG. 9.

FIGS. 9 and 10 illustrate an alternative embodiment of the invention. The device of FIGS. 9 and 10 for aiding in the removal and replacement of the spa cover 16 relative to the spa tub 12 employs the same lifting assemblies 23 and all other structural elements depicted and described in connection with the embodiment of FIGS. 1–8 with the exception of the lag bolts 34 and 94. The embodiment of FIGS. 9 and 10 differs from that of FIGS. 1–8 in that it avoid the penetration of fasteners into the structure of the spa 10.

As best illustrated in FIG. 9, the device employs a pair of supporting stands 100 for each of the lifting assemblies 23. Each of the supporting stands 100 has a base 102 that includes a horizontally oriented, flat, generally square bearing plate 104. The bearing plate 104 extends inwardly from the side walls 15 of the spa tub 12 beneath the floor of the spa tub 12. The base 102 is an angle-shaped structure that also includes an upright, generally vertically oriented, triangular-shaped mounting plate 106. The mounting plate 106 is drilled with a bolt receiving aperture near its apex remote from the plate 104 and is formed with an elongated slot 108 located proximate and parallel to its inclined edge. The slot 108 slants upwardly from the plate 104 toward the mounting plate apex.

The stand 100 also includes a cylindrical, hollow, steel mounting tube 110, preferably having a wall thickness of about one-sixteenth of an inch. The mounting tube 110 has an outer diameter of one and a half inches and is bent at an acute angle of about forty-five degrees to form an upper leg 112 and a lower leg 114. The upper leg 112 includes a cylindrical annular portion that is about twenty-eight inches in length from a pair of diametrically opposed openings through the wall thereof that receive a bolt 113. At its upper extremity the mounting leg 112 is also perforated by a pair of diametrically opposed openings in which the axle pin 95 is welded to project outwardly therefrom. The axle pin 95 passes through the fulcrum opening 28 of the pivot arm 24 and is secured by the push cap 97 to mount the lifting arm 22 for rotation relative to the spa 10. However, instead of being attached directly to the spa 10, the lifting assemblies 23 are supported by the mounting stands 100.

The lower leg 114 of the stand 100 includes twelve sets of diametrically opposed openings 116 therethrough. These openings accommodate a bolt 118 that is directed through a selected pair of openings 116 and through the slot 108. As illustrated in FIG. 9, the anchored ends 30 of the springs 32 are secured to the lower legs 114 of the mounting tubes 110 while the fulcrums 29 of the lifting arms 22 are secured to the upper legs 112 of the mounting tubes 110.

As illustrated in FIG. 10, the bolt 118, the sets of apertures 116 in the lower leg 114, and the inclined slot 108 serve as a clamping means for securing the mounting tubes 110 to the mounting plates 106 at a selected angular orientation relative to the bearing plates 104. One point of attachment of the mounting tube 110 is fixed and is determined by the position of the upper opening through the mounting plate 106 through which the bolt 113 passes. The orientation of the mounting tube 110 relative to the base 102 can be varied by the selection of the set of diametrically opposed openings 116 and the passage of the bolt 118 therethrough into the slot 108. The stand 100 may thereby be used to mount the lifting assemblies 23 with respect to spas 10 of differing configurations. The weight of the water in the spa tub 12 bearing down on the bearing plate 104 is more than adequate to firmly stabilize the base 102 and provide a firm and secure mounting for the lifting assemblies 23.

Figure 11:
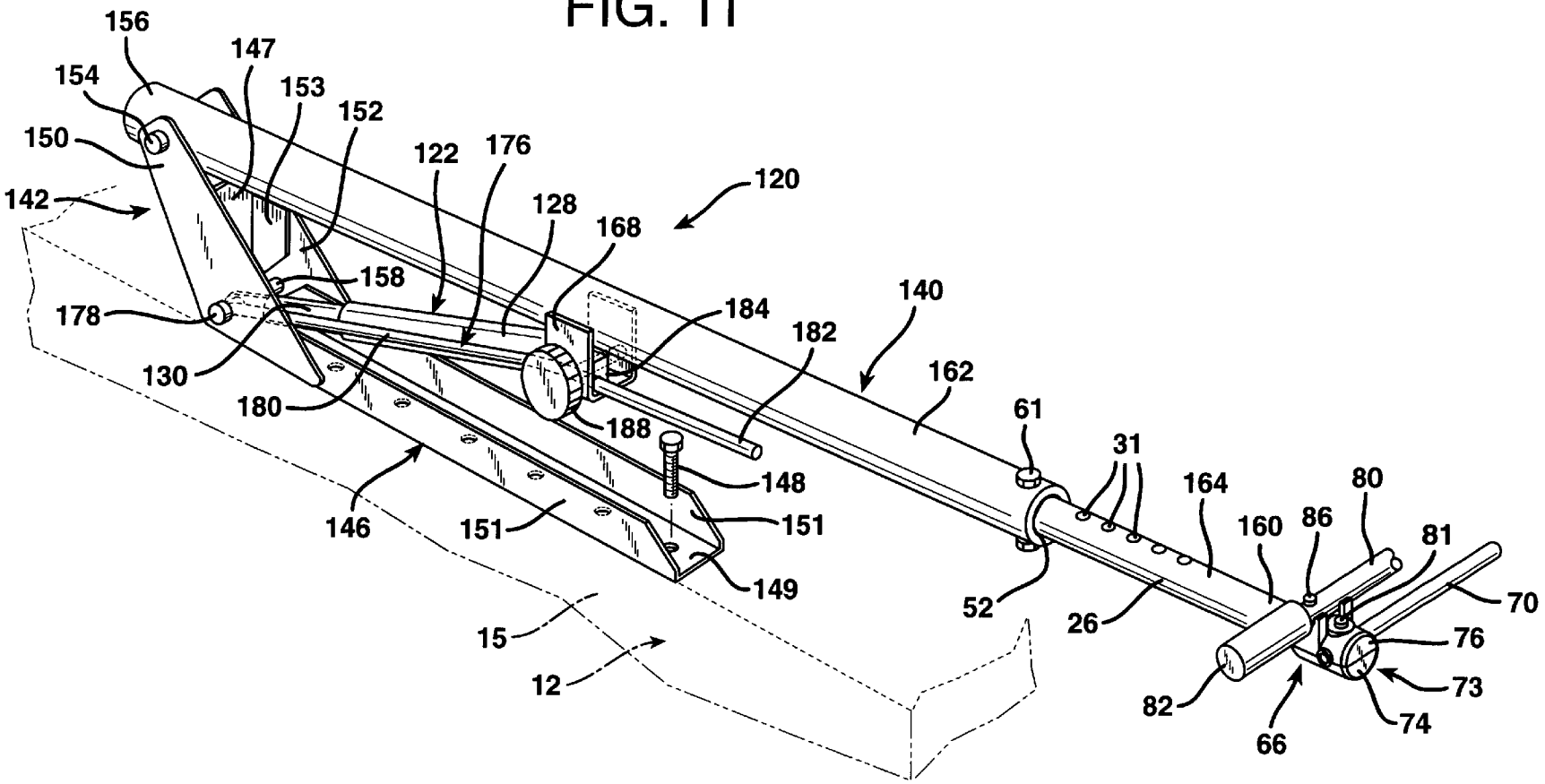
FIG. 11 is a perspective view illustrating one of the lifting assemblies employed in an alternative embodiment of the invention.
Figure 12:
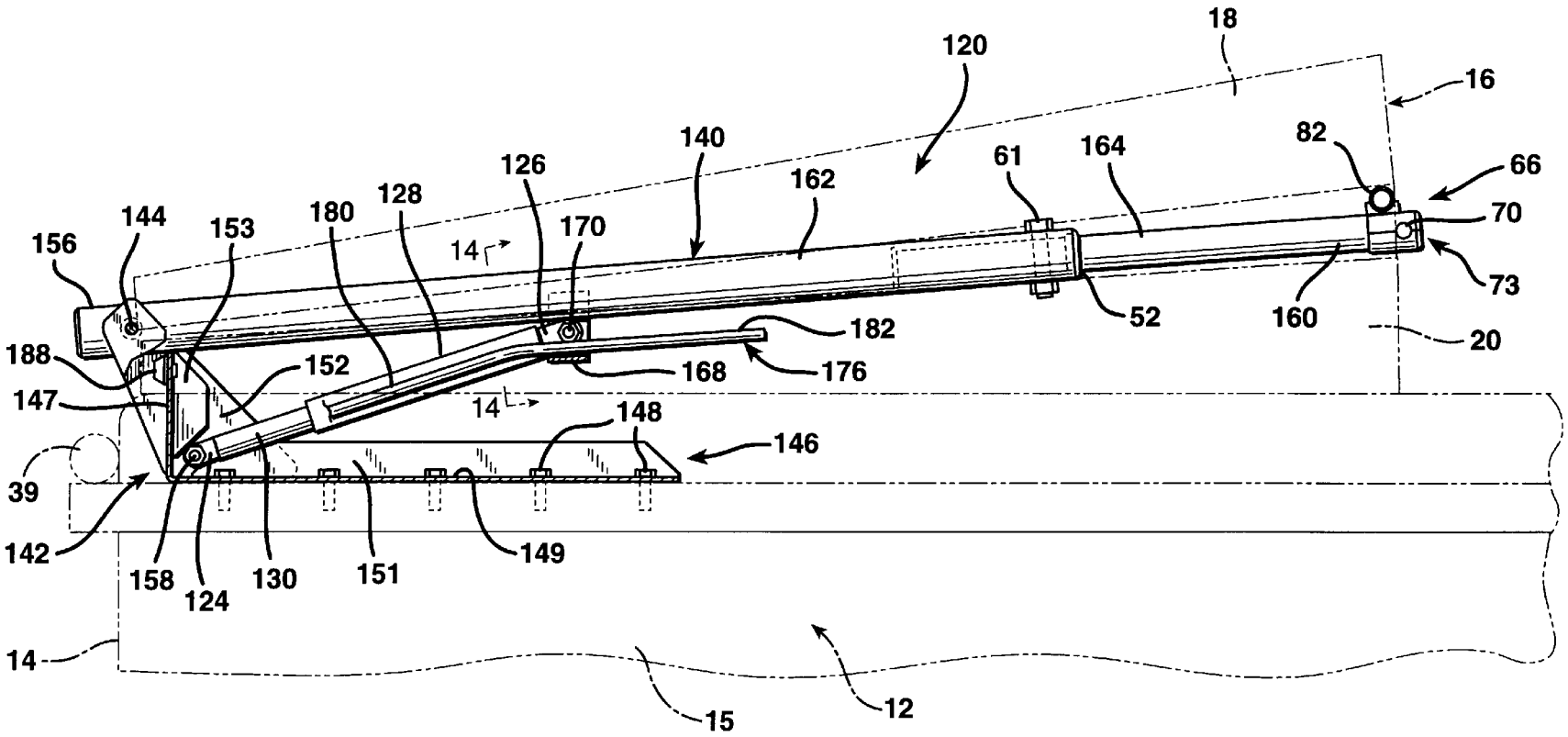
FIG. 12 is a side elevational view of the lifting assembly of FIG. 11 shown in the position that it assumes when the spa cover is replaced atop the spa tub.
Figure 13:
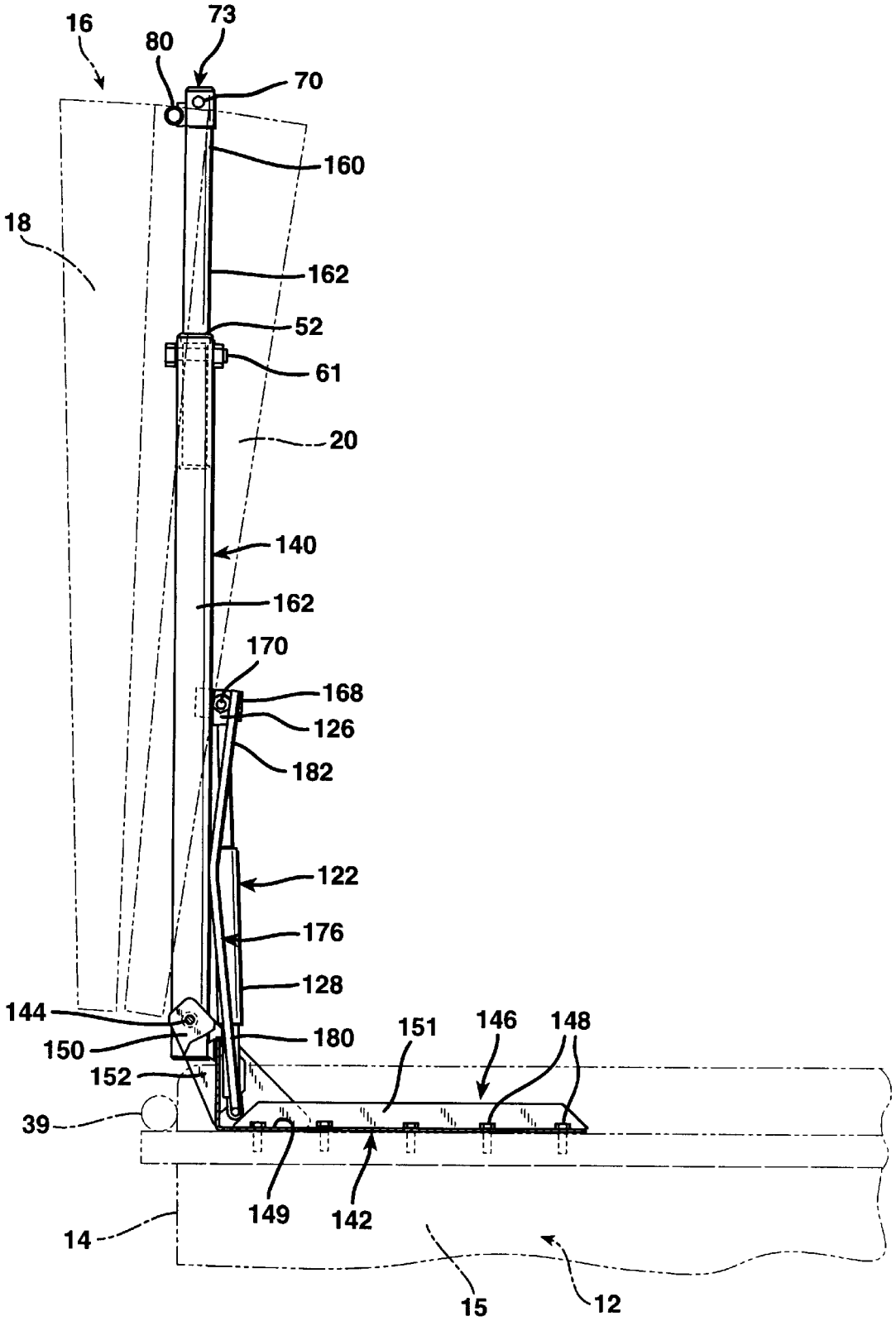
FIG. 13 is a side elevational view of the lifting assembly of FIG. 12 shown in its uncovering position in which the spa cover is raised and stored above one end of the spa tub.

FIG. 11, 12, and 13 illustrate an alternative embodiment of a cover lifting device according to the invention. As shown in those drawing figures the device employs a pair of lifting assemblies 120 located on opposite sides of the spa tub 12. Each of the lifting assemblies 120 includes a spring 122 having an anchored end 124 secured relative to the spa tub 12 and a moveable end 126. In this embodiment of the invention the spring 122 is a gas spring in which air or some other gas is compressed within a blind cylinder member 128 and urges a piston member 130 out from the cylinder member 128. The lifting assemblies 120 also each include a lifting arm 140 mounted relative to a mounting bracket 142 for rotation about a fulcrum pin 144 relative to the spa tub 12.

The mounting bracket 142 is formed of a channel-shaped member 146 having a floor portion 149 secured by lag bolts 148 that extend through longitudinally spaced apertures in the floor portion 149 of the channel member 146 and into the structure of the upper edge of the side walls 15 of the spa tub 12. The floor portion 149 is turned upwardly at its rear end to form an upright end wall 147. A pair of side walls 151 extend longitudinally along the length of the channel member 146. The channel side walls 151 are notched adjacent the end wall 147 to form flanges 153 extending forwardly therefrom. A pair of flat mounting plates 150 and 152 are welded to the rear extremities of the mutually parallel vertical side walls 151 of the channel member 146 at the rear ends thereof. The flanges 153 are also welded to the interior surfaces of the mounting plates 150 and 152. The mounting plates 150 and 152 are both shaped as obtuse triangles and include apertures therethrough near the rearmost apices thereof. The uppermost of these apertures receives the fulcrum pin 144 which is secured to the mounting plates 150 and 152 by means of a push cap 154. The lifting arm 140 has a fulcrum end 156 with diametrically opposed openings therethrough that receives the fulcrum pin 144. The fulcrum end 156 is secured relative to the spa tub 12 at a distance from the anchored end 124 of the gas spring 122, which is secured by a bolt 158 to the mounting plate 152 for rotation relative thereto.

Figure 5A:
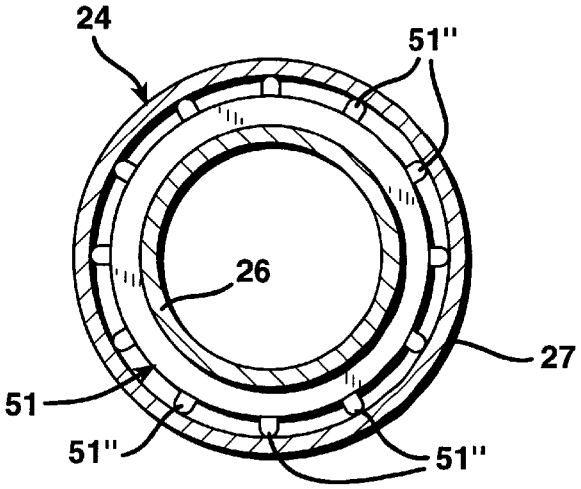
FIG. 5A is a transverse sectional detail taken along the lines 5A—5A of FIG. 5.

At its opposite end 160 the lifting arm 140 includes a cover-engaging and lift grip assembly 66, identical to that depicted in FIG. 3. Also, telescoping adjustment between the outer tubular telescoping member 162 and the inner tubular telescoping member 164 of the lifting arm 140 is identical to that of the lifting arm 22 depicted and described in connection with FIGS. 5, 5A, and 6.

The lifting arm 140 is formed with an intermediate, U-shaped spring coupling bracket 168 which is welded to the sides of the outer telescoping member 162 at an intermediate location between the lifting arm ends 156 and 160. The U-shaped coupling bracket 168 is thereby permanently secured to the lifting arm 140 and includes a pair of transverse, aligned openings therethrough, one of which receive a bolt 170 that passes through the moveable end 126 of the gas spring 122. The spring coupling bolt 170 thereby forms a hinged connection between the moveable end 126 of the gas spring 122 and the lifting arm 140 at a location between the fulcrum end 156 and the cover-engaging end 160 of the lifting arm 140.

The lifting assembly 120 also includes a thin, solid support rod 176 which has a fixed end 180 the extremity of which is bent laterally at a right angle and passes through the lowermost opening in the triangular mounting plate 150, where it is secured to permit rotation relative to the mounting plate 150 by means of a locking push cap 178. The push cap 178 thereby secures the support rod 176 relative to the spa tub 12 at its fixed end 180. The fixed end 180 rotates about an axis of rotation that resides in coaxial alignment with the anchoring bolt 158 that secures the end 124 of the gas spring 122 to the mounting plate 152. The lower extremity of the fixed end 180 and its connection to the mounting plate 150 is broken away in FIG. 12, but is illustrated in FIG. 11.

The support rod 176 is preferably about twenty inches in overall length and has a diameter of 0.375 inches. The support rod 176 extends linearly from its fixed end 180 for a length of about nine and a half inches, where it is bent at an obtuse angle of about one hundred sixty-six and a half degrees. From this bend the moveable free end 182 of the support rod 176 extends to its distal, free extremity a distance of about seven and one-quarter inches.

The opposite, moveable end 182 of the support rod 176 passes adjacent the lifting arm 140 and is mounted in sliding engagement relative thereto. More specifically, and as illustrated in FIG. 14, the moveable end 82 of the support rod 176 passes between the legs of the U-shaped coupling bracket 168 and may be releasably clamped thereagainst by means of a clamping block 184.

Figure 14:
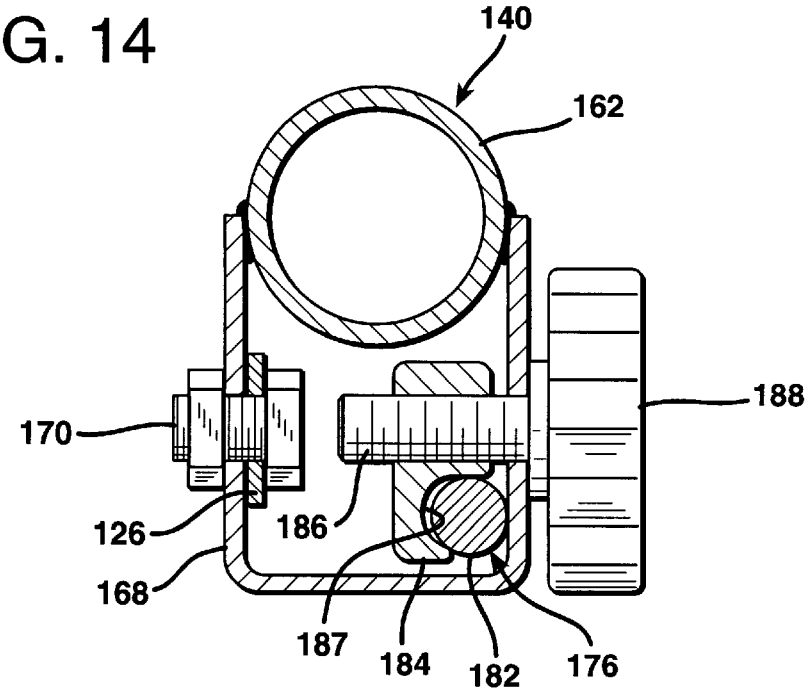
FIG. 14 is a transverse sectional detail taken along the lines 14—14 of FIG. 12.

As illustrated in FIG. 14, the clamping block 184 has a transverse, internally-threaded aperture therethrough that receives the threaded shank 186 that projects transversely from a clamping knob 188. The clamping knob 188 has a knurled, peripheral surface which facilitates grasping with the fingers of an operator's hands. The clamping block 184 also includes a concave recess 187 of a size and shape that conforms to the cylindrical shape of the support rod 176.

The lifting assemblies 120 are normally employed in situations in which the space 138 between the wall 140 of the room in which the spa 10 is installed and the end wall 14 of the spa 10 is inadequate to receive the spa cover 16 in the manner depicted in FIG. 2. Therefore, it is necessary for the spa cover 16 to be stored in a folded, upright disposition above the level of the spa tub 12 in the manner depicted in FIG. 13.

In the operation of the lifting device employing a pair of lifting assemblies 120, the spa cover 16 is secured to the cover-engaging and lift grip assembly 66 in the manner previously described in conjunction with FIG. 3. The channel member 146 is secured by lag bolts 148 to the spa tub 12 above the side walls 15 thereof in the manner depicted in FIGS. 11, 12, and 13. The inner telescoping member 164 is then extended from the outer telescoping member 162 of each lifting arm 140 and secured relative thereto in the manner depicted and described in conjunction with FIGS. 5, 5A, and 6.

To raise the spa cover 16 from its deployed position covering the spa tub 12, the cover section 18 is folded back atop the cover section 20 as illustrated in FIG. 12. The user ensures that the clamping knob 188 is loosened so that the clamping block 184 will permit the free end 182 of the support rod 176 to slide relative thereto and relative to the lifting arm 140.

The handgrip 82 of one of the lifting assemblies 122 is then grasped by the user and a lifting force, which may be very small, is applied to lift the spa cover 16 from its lowered position depicted in FIG. 12 to its raised position depicted in FIG. 13. As in the other embodiments of the invention, the gas spring 122 exerts a lifting force that aids the user in raising the spa cover 16. Also as in the other embodiments, as the cover 16 is raised to a generally upright disposition, the lifting force decreases due to the extension of the piston element 130 from the cylinder element 128 of the gas spring 122. The spa cover 16 is raised until it resides at a disposition in which the lifting arm 140 has been rotated past a position perpendicular to horizonal, so that the weight of the spa cover 16 no longer exerts a clockwise moment on the lifting arm 140, but to the contrary exerts a slight counterclockwise moment as depicted in FIG. 13.

To ensure that some external force does not accidentally cause the cover 16 to move past the top dead center, from the raised position depicted in FIG. 13 which would allow the weight of the cover 16 to exert a clockwise moment as viewed in FIGS. 12 and 13, the clamping knob 188 is thereupon tightened with the spa cover 16 in the raised position shown in FIG. 13. Tightening of the clamping knob 188 draws the clamping block 184 toward the near side wall of the coupling bracket 168, thereby clamping the support rod 176 thereagainst. This prevents any sliding movement of the support rod 176 relative to either the coupling bracket 168 or the lifting arm 140, and thereby holds the lifting arm 140 in the raised, cover-lifting position depicted in FIG. 13, or in the lowered, cover deployed position depicted in FIG. 12.

It should be noted, as illustrated in FIG. 13, that the lifting assembly 120 is provided with a positive stop in the form of a rubber snubber 188 that is mounted at the upper extremity of the end wall 147 of the channel member 146. The rubber snubber 188 provides a cushion to terminate the movement of the lift arm 140 in a counterclockwise direction, as viewed in FIG. 13. The rubber snubber 188 ensures that the cover 16 is not carried to far over dead center above the fulcrum pin 144 so as to contact the wall immediately adjacent thereto. The rubber snubber 188 may be secured by adhesive to the end wall 147, or merely wedged in between the upright mounting plates 150 and 152. As the upper, transverse cover-engaging member 87 passes over a vertical plane in which the transverse fulcrum pin 144 resides, the extremity of the fulcrum end 156 of the lifting arm 140 is rotated into abutment against the rubber snubber 188, thereby halting movement of the spa cover 16 in a cushioned, controlled manner. Without the type of damping provided by the rubber snubber 188, stress would be increased on the hardware and on the mounting bolts. As a consequence, use of the rubber snubber 188 allows lighter weight, less expensive hardware and bolts to be utilized.

Figure 15:
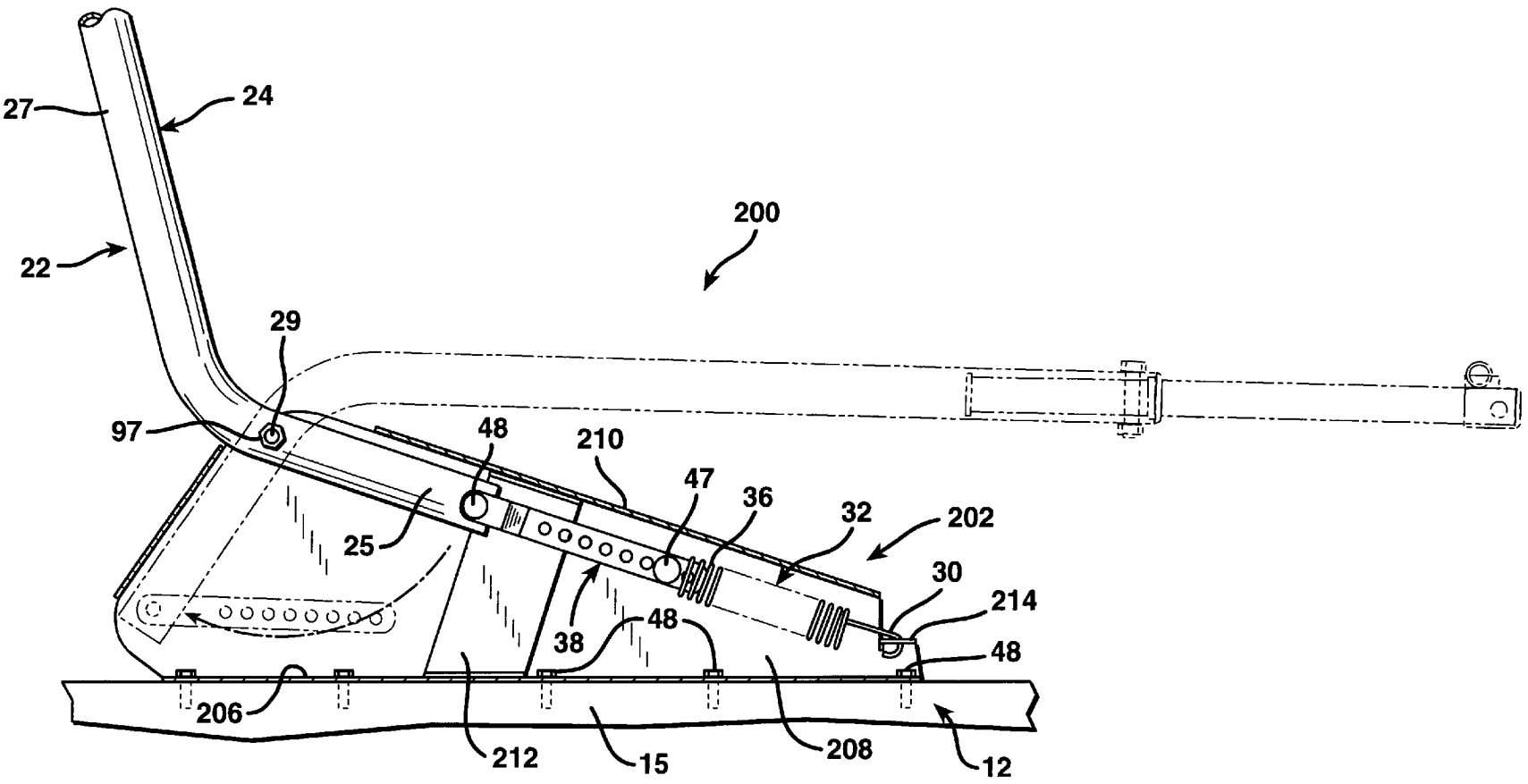
FIG. 15 is a side elevational view of a lifting assembly of another embodiment of the invention shown in solid lines in its cover removal position and in phantom in its cover replacement position.
Figure 16:
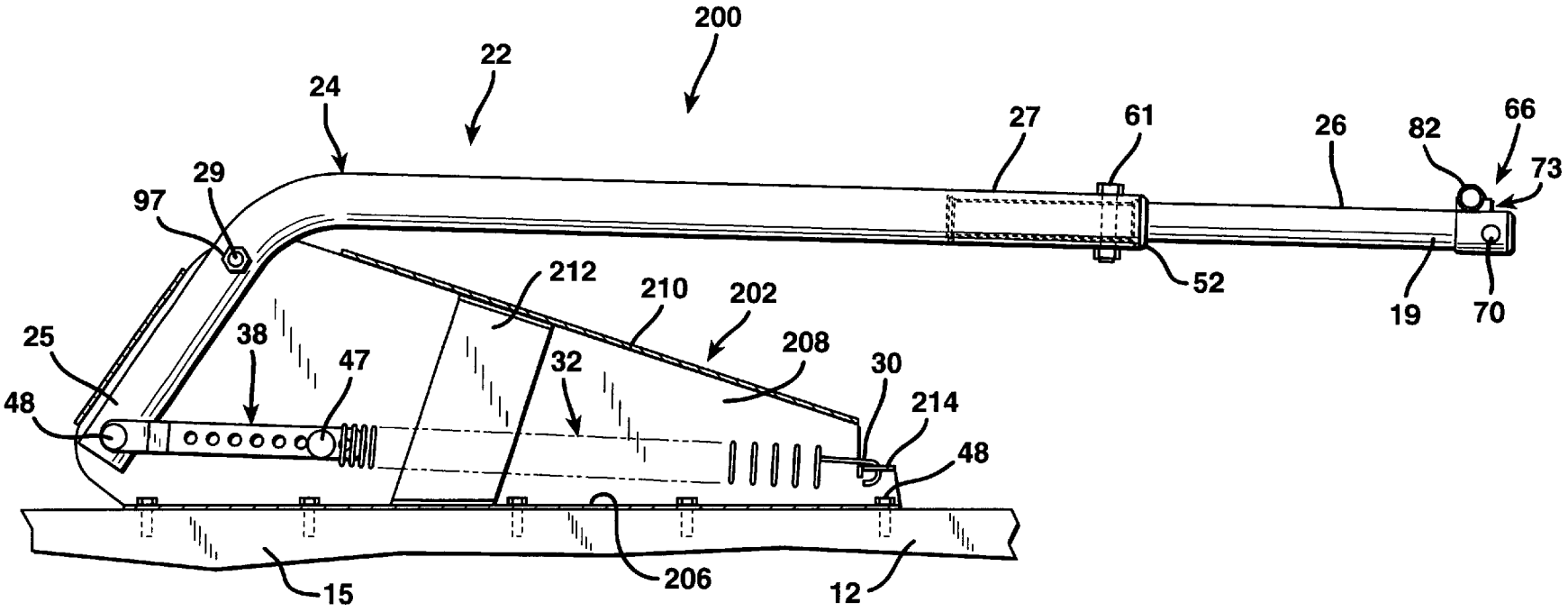
FIG. 16 is a side elevational view of the lifting assembly of FIG. 15 shown in solid lines in its cover replacement position.

FIGS. 15 and 16 illustrate still another embodiment of a spa lifting device constructed according to the invention. This device employs a pair of lifting assemblies 200 depicted in FIGS. 15 and 16. Each lifting assembly 200 employs a lifting arm 22, a tension adjustment link 38, and an extended coil spring 32 which are constructed and operate in the same manner depicted in FIGS. 1–8. The lifting assembly 200 differs from the lifting assembly 23, however, in that it employs a mounting bracket 202 that is secured to the upper portion of the spa tub 12. The fulcrum forming the axis of rotation 29 of the lifting arm 22 and the anchored end 30 of the spring 32 are both coupled to the mounting bracket 202 at spaced locations thereon in each of the lifting assemblies 200.

The mounting bracket 202 is formed as an angle-shaped member having a flat floor portion 206 that is secured to the upper edge of a spa tub side wall 15 by means of the same lag bolts 148 employed in the embodiment of FIGS. 12 and 13. The mounting bracket 202 also includes an upright side panel 208 having a generally triangular configuration with a fulcrum aperture near its uppermost apex. The fulcrum pin 95 passes through this fulcrum aperture and is secured relative to the upright mounting plate 209 by means of the push cap 97 employed in the embodiment of FIGS. 1–8.

Forward of the axis of rotation 29, the structure of the mounting bracket 202 is bent over to form a transverse, inclined wall 210. A U-shaped reinforcing strut 212 is welded to the floor 206, the transverse, inclined wall 210, and the upright mounting wall 208 to provide structural support sufficient to withstand the weight of the spa cover 16. At its forward extremity a horizontally oriented, spring-anchoring tang 214 is bent over to extend laterally above the floor 206. The spring anchoring tang 214 has an aperture therethrough that receives the hook of the anchoring end 30 of the extended spring 32.

The movement of the lifting arm 22 in one of the lifting assemblies 200 is illustrated in FIGS. 15 and 16. FIG. 16 illustrates the disposition of the lifting arm 22 when the cover 16 is deployed in a position atop the spa tub 12 covering the surface thereof. In this position the coil spring 32 is extended a considerable distance under tension, and thereby exerts a strong counterclockwise force tending to raise the spa cover 16.

In moving from the cover closing disposition illustrated in phantom in FIG. 15, to the cover raised position illustrated in solid lines in that drawing figure, the lifting arm 22 rotates in a counterclockwise direction. As a consequence, the spring attachment end 25 of the lifting arm 22 moves a considerable distance closer to the anchored end 30 of the spring 32 than it does when the cover is deployed atop the spa tub 12. As a result, when the cover 16 is in a raised disposition, suspended from the cover-engaging and lift grip assembly 66 the spring 32 is relaxed considerably, as illustrated in FIG. 15, and thereby exerts a much smaller force tending to open the cover 16.

As with the embodiment of FIGS. 1–8, the spa lifting device of FIGS. 15 and 16 provides a cushioning force when the spa cover 16 is to be closed. That is, as the spa cover 16 is moved from the open position of FIG. 15 to the closed position of FIG. 16, the rotation of the lifting arm 22 in the clockwise direction relative to the mounting bracket 202 pulls the moveable end 36 of the tensioned coil spring 32 away from the anchor tang 214. This extends the springs 32, thereby causing them to exert a force opposing closure of the spa cover 16. This force is not great enough to prevent the spa cover 16 from closing. However, it is substantial enough to cushion the spa cover 16 as the cover 16 moves from its open position depicted in solid lines in FIG. 15 to its closed position indicated in phantom in that same drawing figure and in FIG. 16.

Undoubtedly, numerous variations and modifications of the invention will become readily apparent to those familiar with spa covers. Accordingly, the scope of the invention should not be construed as limited to this specific embodiment depicted and described.

I claim:

1. In combination, a spa having a tub with a pair of opposing transverse end walls and a pair of opposite side walls, each side wall having a top and a bottom, a folding spa cover divided longitudinally into two sections and including a cover hinge that extends transversely between said opposite side walls of said spa tub, wherein said spa cover sections are foldable together at said hinge, and a device for aiding removal and replacement of said spa cover relative to said spa tub comprising a pair of lifting assemblies each of which is secured relative to said spa tub on a separate one of said opposite side walls, each lifting assembly including:

a spring having an anchored end secured relative to said spa tub and a moveable end, wherein said anchored end is attached to one of said side walls of said tub near said bottom thereof, a single lifting arm mounted for rotation relative to said spa tub and including a cover-engaging end attached to said spa cover proximate said spa cover hinge, a spring-engaging end attached to said moveable end of said spring, and a fulcrum located between said lifting arm ends and attached to said one of said side walls near said top thereof and defining a lifting arm axis of rotation, and said lifting arm is rotatable between extreme covering and uncovering positions in which said moveable end of said lifting arm lies on opposite sides of a straight line extending between said lifting arm axis of rotation and said anchored end of said spring and said lifting arm is rotatable through an intermediate position in which said moveable end of said lifting arm lies on said straight line whereby said spring exerts a spring biasing moment on said lifting arm urging said lifting arm toward said intermediate position and said cover exerts a gravitational moment on said lifting arm that opposes said spring biasing moment when said lifting arm is at said extreme positions, and said spring biasing moment is less than said gravitational moment.

2. A combination according to claim 1 wherein said spring is a coil spring biased in tension.

3. A combination according to claim 1 further comprising a link of adjustable effective length interposed between each spring-engaging end of each lifting arm and each moveable end of each spring to permit adjustment of tension on said coil springs.

4. A combination according to claim 1 further comprising lower transverse cover-engaging members extending from said cover-engaging ends of said lifting arms beneath said spa cover hinge, and an upper, transverse cover-engaging member extending between said cover-engaging ends of said lifting arms above one of said spa cover sections.

5. A combination according to claim 4 wherein said upper, transverse, cover-engaging member is comprised of a pair of outboard tubes secured to said cover-engaging ends of said lifting arms and having inboard ends of polygonal cross section directed toward each other, and an inboard connecting tube having opposing ends of corresponding polygonal cross section that telescopically engage said inboard ends of said outboard tubes.

6. If A device according to claim 5 further comprising a cradle at each of said cover-engaging ends of said lifting arms, each cradle defining a saddle for seating separate ones of said inboard ends of said outboard tubes therein.

7. A combination according to claim 1 wherein each lifting arm employs at least one set of telescoping members, each set including an outer telescoping member having a coupling end with an interior wall and an inner telescoping member partially disposed within said outer telescoping member and partially protruding longitudinally therefrom beyond said coupling end thereof, and further comprising an annular compression collar interposed between said inner and outer telescoping members in each of said sets, each of said annular collars having inner, radially projecting ribs and an outer, radially projecting flange wherein said radially projecting ribs contact said interior wall of said outer telescoping member and are radially compressed between said inner and outer telescoping members and said outer flanges reside in abutment against said coupling ends of said outer telescoping members, and wherein said inner telescoping member has an inner end extremity, and further comprising an annular cap having a plurality of ribs projecting radially therefrom on said inner end extremity of said inner telescoping member, and said ribs on said annular cap projecting radially outwardly to frictionally engage said outer telescoping member.

8. A combination according to claim 1 wherein each of said fulcrums is attached to said tub at least about eleven inches from the nearest of said transverse end walls.

* * * * *